US009360793B2

(12) United States Patent
Iriyama et al.

(10) Patent No.: US 9,360,793 B2
(45) Date of Patent: Jun. 7, 2016

(54) DEVELOPING CARTRIDGE AND PROCESS CARTRIDGE

(71) Applicant: Brother Kogyo Kabushiki Kaisha, Nagoya-shi, Aichi-ken (JP)

(72) Inventors: Shota Iriyama, Toyokawa (JP); Soun Kanada, Nagoya (JP); Takashi Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/934,682

(22) Filed: Nov. 6, 2015

(65) Prior Publication Data

US 2016/0062263 A1 Mar. 3, 2016

Related U.S. Application Data

(63) Continuation of application No. 14/589,365, filed on Jan. 5, 2015, now Pat. No. 9,195,165.

(30) Foreign Application Priority Data

Jan. 6, 2014 (JP) ..... 2014-000601

(51) Int. Cl.
*G03G 15/08* (2006.01)
*G03G 15/06* (2006.01)

(52) U.S. Cl.
CPC ..... *G03G 15/065* (2013.01); *G03G 15/0865* (2013.01)

(58) Field of Classification Search
CPC ..... G03G 15/065; G03G 15/0865
See application file for complete search history.

(56) References Cited

U.S. PATENT DOCUMENTS 5,345,294 A 9/1994 Nomura et al.
5,446,525 A 8/1995 Kobayashi
2006/0291893 A1* 12/2006 Yano ..... G03G 15/80 399/90
2007/0009282 A1* 1/2007 Sato ..... G03B 21/18 399/90
2010/0135689 A1 6/2010 Abe et al.
2011/0103837 A1 5/2011 Toyoda et al.
2011/0158685 A1 6/2011 Takagi et al.
2015/0125176 A1 5/2015 Fujii et al.
2015/0192892 A1* 7/2015 Iriyama ..... G03G 21/1676 399/90

FOREIGN PATENT DOCUMENTS

JP 2011133766 A 7/2011
JP 2014016483 A 1/2014

OTHER PUBLICATIONS

Jul. 14, 2015—(US) Notice of Allowance—U.S. Appl. No. 14/589,365.

* cited by examiner

*Primary Examiner* — G. M. Hyder
(74) *Attorney, Agent, or Firm* — Banner & Witcoff, Ltd.

(57) ABSTRACT

A developing cartridge includes a developing roller with a shaft, a housing with a wall portion, a developing electrode, a first contact portion, a second contact portion, and a connecting portion. The developing electrode includes a first contact portion contacting the shaft and has a first surface against which an apparatus electrode of an image forming apparatus body slides, a second contact portion disposed next to the first contact portion, and a second surface configured to contact an electrode of the image forming apparatus. The connecting portion includes a first inclined surface connecting the first surface and the second surface with each other and being contiguous with the first surface. The first inclined surface is inclined toward the second contact portion from the first contact portion such that the first inclined surface extends in a direction away from the wall portion.

15 Claims, 12 Drawing Sheets

DEVELOPING CARTRIDGE AND PROCESS CARTRIDGE

CROSS-REFERENCE TO RELATED APPLICATION

This application claims priority from U.S. Ser. No. 14/589,365, filed Jan. 1, 2015, which claims priority from Japanese Patent Application No. 2014-000601, filed on Jan. 6, 2014, which are incorporated herein by reference in their entirety.

TECHNICAL FIELD

Aspects disclosed herein relate to a developing cartridge and a process cartridge for an electrophotographic image forming apparatus.

BACKGROUND

A known image forming apparatus includes a printer that includes a cartridge including a developing roller. The cartridge is configured to be detachable from the printer.

Such a cartridge includes a developing cartridge that includes a developing electrode electrically connected to a roller shaft of the developing roller.

The developing cartridge is configured to be installed into the printer such that the developing electrode is slid against a developing contact of the printer.

The roller shaft of the developing roller and a portion, which comes into contact with the developing contact, of the developing electrode are displaced with each other with respect to a direction intersecting with an installation direction of the developing cartridge to the printer. This configuration prevents or reduces a contact between the developing contact and the roller shaft of the developing roller during the installation of the developing cartridge to the printer.

SUMMARY

Recently, size reduction of the printer may be expected and thus the developing cartridge to be installed in the printer may need to have a thin body.

In order to reduce the thickness of the developing cartridge, the developing electrode and the roller shaft of the developing roller may be aligned along the installation direction of the developing cartridge to the printer. In this case, during the installation of the developing cartridge to the printer, however, the roller shaft of the developing roller of the developing cartridge may come into contact with the developing contact of the printer before the developing electrode comes into contact with the developing contact of the printer, whereby one of the roller shaft of the developing roller or the developing contact may be damaged.

Accordingly, for example, aspects of the disclosure provide for a developing cartridge and a process cartridge that may enable appropriate contact of a developing electrode to an apparatus electrode while sizes of the developing cartridge and the process cartridge are reduced.

Aspects of the disclosure describe a developing cartridge with a developing roller with a shaft, a housing with a wall portion, a developing electrode, a first contact portion, a second contact portion, and a connecting portion. The developing electrode may include a first contact portion contacting the shaft and may have a first surface against which an apparatus electrode of an image forming apparatus body slides, a second contact portion disposed next to the first contact portion, and a second surface configured to contact an electrode of the image forming apparatus. The connecting portion may include a first inclined surface connecting the first surface and the second surface with each other and being contiguous with the first surface. The first inclined surface may be inclined toward the second contact portion from the first contact portion such that the first inclined surface extends in a direction away from the wall portion.

According to the aspects of the disclosure, the developing cartridge or the process cartridge may ensure appropriate contact of the developing electrode to the apparatus electrode while a size of the developing cartridge or the process cartridge is reduced.

DESCRIPTION OF THE DRAWINGS

Aspects of the disclosure are illustrated by way of example and not by limitation in the accompanying figures in which like reference characters indicate similar elements.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments of the disclosure will be described in detail with reference to the accompanying drawings.

1. General Configuration of Developing Cartridge

Figure 1A:
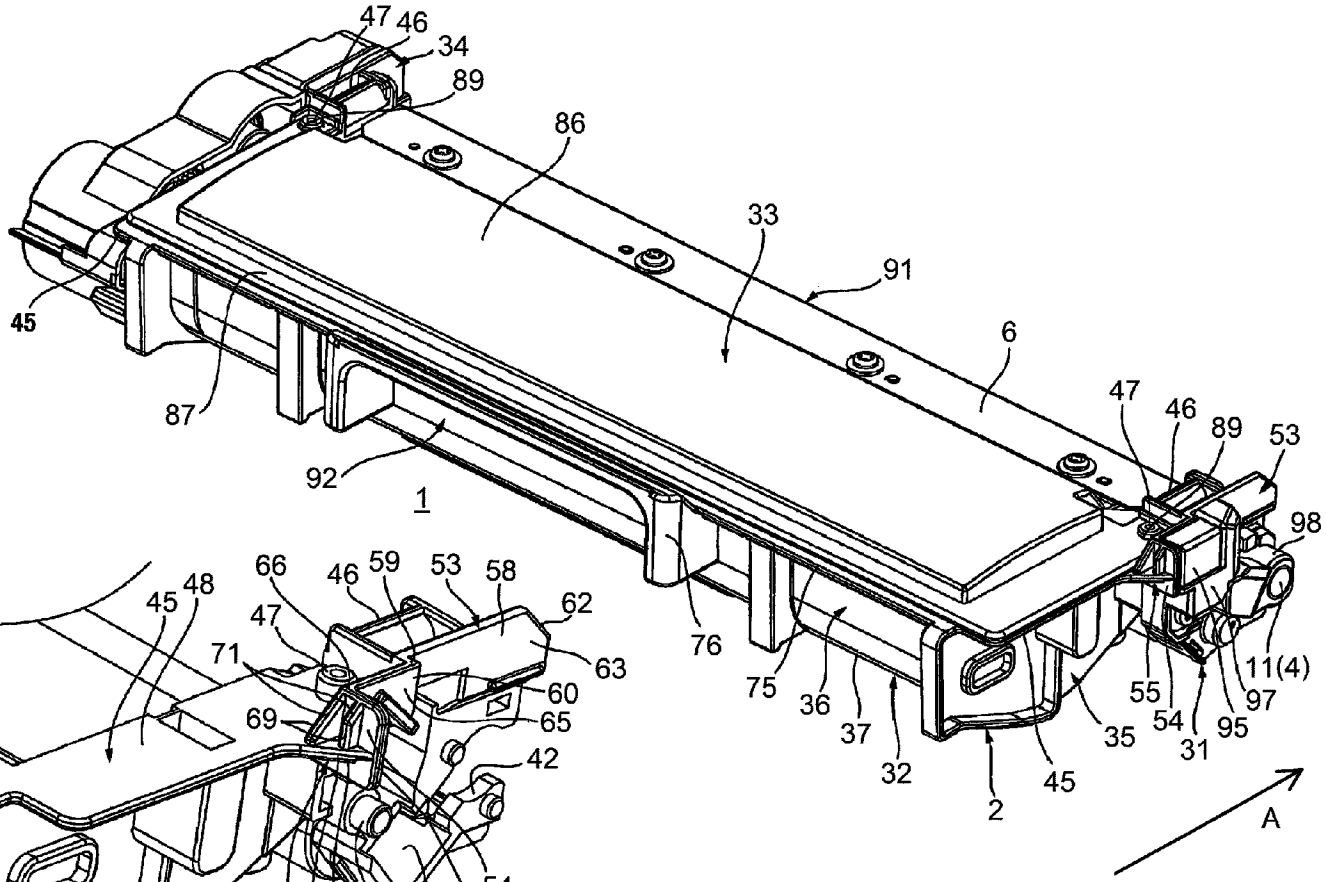
FIG. 1A is a right front perspective view depicting a developing cartridge in a first illustrative embodiment according to one or more aspects of the disclosure.
Figure 2:
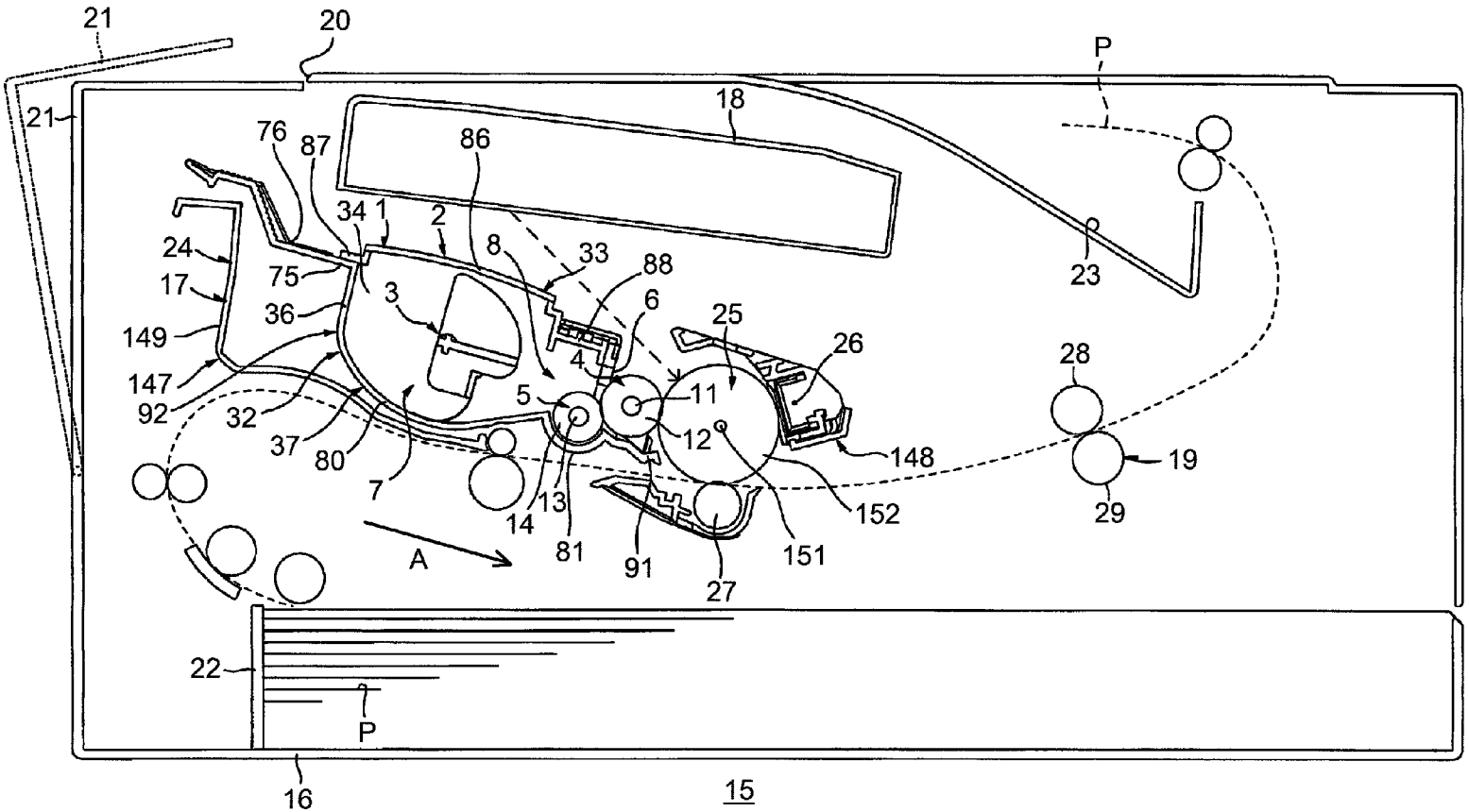
FIG. 2 is a vertical, central cross sectional view depicting a printer including the developing cartridge depicted in FIG. 1A in the first illustrative embodiment according to one or more aspects of the disclosure.

As depicted in FIGS. 1A and 2, a developing cartridge 1 includes a developing frame 2, an agitator 3, a developing roller 4, a supply roller 5, and a layer-thickness regulating blade 6. The developing frame 2 is an example of a housing.

In the description below, the side on which the developing roller 4 is disposed in the developing cartridge 1 is defined as the rear of the developing cartridge 1 and the opposite side of the developing cartridge 1 is defined as the front of the developing cartridge 1. The right and left are defined with reference to the front of the developing cartridge 1.

A right-left direction is an example of a first direction. An up-down direction is an example of a second direction. A front-to-rear direction is an example of an installation direction. Forward is an example of upstream in the installation direction, and rearward is an example of downstream in the installation direction.

The developing frame 2 has a substantially box shape extending in the right-left direction. A rear end portion of the developing frame 2 is opened in a front-rear direction. As depicted in FIG. 2, the developing frame 2 includes a toner chamber 7 and a developing chamber 8 that are aligned in the front-rear direction. The toner chamber 7 is configured to store therein toner that is an example of a developing agent.

The agitator 3 is rotatably disposed at a substantially middle portion of the toner chamber 7 in the front-rear direction and in the up-down direction.

The developing roller 4 is rotarably supported by a rear end portion of the developing chamber 8. The developing roller 4 includes a shaft portion 11 and a body portion 12. The shaft portion 11 has a substantially circular pillar shape extending in the right-left direction. The body portion 12 covers a substantially middle portion of the shaft portion 11 in the right-left direction. Upper and rear portions of the body portion 12 are exposed from the developing frame 2.

The supply roller 5 is rotatably disposed below and in front of the developing roller 4 in the developing chamber 8. The supply roller 5 has a shaft portion 13 and a body portion 14. The shaft portion 13 has a substantially circular pillar shape extending in the right-left direction. The body portion 14 covers a substantially middle portion of the shaft portion 13 in the right-left direction. An upper-rear end portion of the body portion 14 of the supply roller 5 is in pressure contact with a front-lower end portion of the body portion 12 of the developing roller 4.

The layer-thickness regulating blade 6 is disposed above and in front of the developing roller 4 in the developing chamber 8. As depicted in FIGS. 2 and 3A, the layer-thickness regulating blade 6 is supported by the developing frame 2 while a lower end portion of the layer-thickness regulating blade 6 is in contact with an upper-front end portion of the developing roller 4.

2. Overall Configuration of Printer

As depicted in FIG. 2, a printer 15 may be an electrophotographic monochrome printer. The printer 15 includes a body casing 16, a process cartridge 17, a scanner unit 18, and a fixing unit 19. The body casing 16 is an example of an image forming apparatus body.

The body casing 16 has a substantially box shape. The body casing 16 has an opening 20 and includes a front cover 21, a sheet feed tray 22, and a sheet discharge tray 23.

The opening 20 penetrates a front wall of the body casing 16 in a front-rear direction of the printer 15. The opening 20 provides communication between the inside and the outside of the body casing 16 in the front-rear direction of the printer 15 to allow the process cartridge 17 to pass therethrough.

The front cover 21 has a substantially L-shaped plate shape in side view. The front cover 21 is supported by the front wall of the body casing 16 so as to be rotatable on its lower end. The front cover 21 is configured to expose or close the opening 20.

The sheet feed tray 22 is disposed at a bottom portion of the body casing 16. The sheet feed tray 22 is configured to accommodate one or more sheets P therein.

The sheet discharge tray 23 is disposed at an upper surface of the body casing 16.

The process cartridge 17 is configured to be installed to and detached from the body casing 16 via the opening 20. The process cartridge 17 includes a drum cartridge 24 and the developing cartridge 1.

The drum cartridge 24 includes a photosensitive drum 25, a scorotron charger 26, and a transfer roller 27.

The photosensitive drum 25 is disposed at a rear end portion of the drum cartridge 24. The photosensitive drum 25 has a substantially circular cylindrical shape extending in the right-left direction. The photosensitive drum 25 is rotatably supported by the drum cartridge 24.

The scorotron charger 26 is disposed behind the photosensitive drum 25 and spaced apart from the photosensitive drum 25.

The transfer roller 27 is disposed below the photosensitive drum 25. The transfer roller 27 is in contact with a lower end portion of the photosensitive drum 25.

The developing cartridge 1 is configured to be attached to and detached from the drum cartridge 24. In a state where the developing cartridge 1 is attached to the drum cartridge 24, a rear end portion of the developing roller 4 is in contact with a front end portion of the photosensitive drum 25.

The scanner unit 18 is disposed above the process cartridge 17. The scanner unit 18 is configured to irradiate the photosensitive drum 25 with a laser beam based on image data as indicated by a dashed line in FIG. 2.

The fixing unit 19 is disposed behind the process cartridge 17. The fixing unit 19 includes a heat roller 28 and a pressure roller 29. The pressure roller 29 is disposed below and behind the heat roller 28 and is in contact with a lower-rear end portion of the heat roller 28.

As the printer 15 starts an image forming operation under control of a controller (not depicted), the scorotron charger 26 charges a surface of the photosensitive drum 25 uniformly and the scanner unit 18 exposes the surface of the photosensitive drum 25 with a laser beam. Thus, an electrostatic latent image based on image data is formed on the surface of the photosensitive drum 25.

The supply roller 5 supplies toner to the developing roller 4 in the developing frame 2. Meanwhile, toner is positively charged between the developing roller 4 and the supply roller 5 and is then carried by the developing roller 4, and the layer-thickness regulating blade 6 regulates a thickness of a toner layer carried by the developing roller 4.

The toner carried by the developing roller 4 is then supplied onto the electrostatic latent image formed on the surface of the photosensitive drum 25. Thus, a toner image is carried by the surface of the photosensitive drum 25.

One or more sheets P are fed, one by one, to between the photosensitive drum 25 and the transfer roller 27 at a predetermined timing from the sheet supply tray 22 by rotation of the rollers. The toner image formed on the surface of the photosensitive drum 25 is transferred onto the sheet P while the sheet P passes between the photosensitive drum 25 and the transfer roller 27.

Then, the sheet P is applied with heat and pressure while the sheet P passes between the heat roller 28 and the pressure roller 29, whereby the toner image transferred onto the sheet P is fixed by heat thereon. After the toner image is fixed on the sheet P, the sheet P is discharged onto the sheet discharge tray 23.

3. Details of Developing Cartridge

Figure 6B:
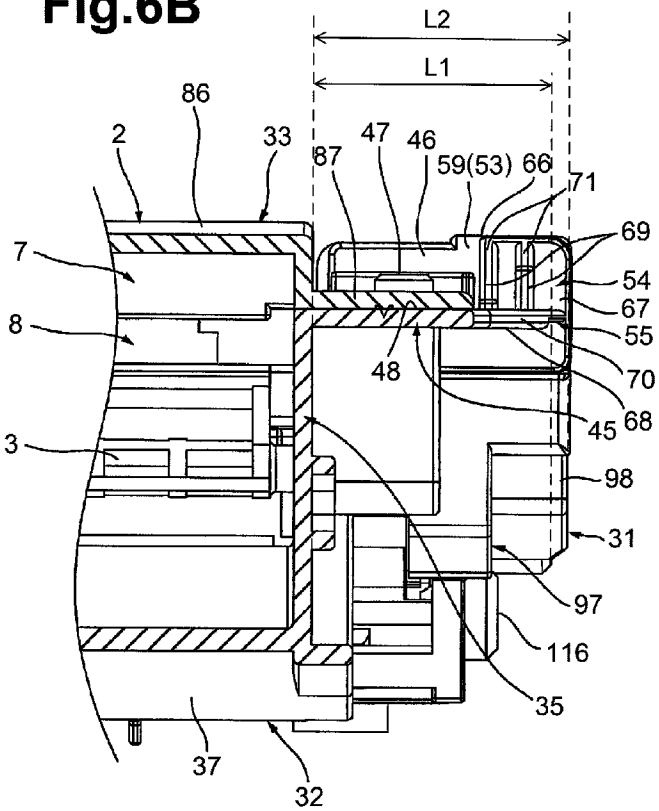
FIG. 6B is a sectional view taken along a line A-A of FIG. 6A in the illustrative embodiment according to one or more aspects of the disclosure.
Figure 6A:
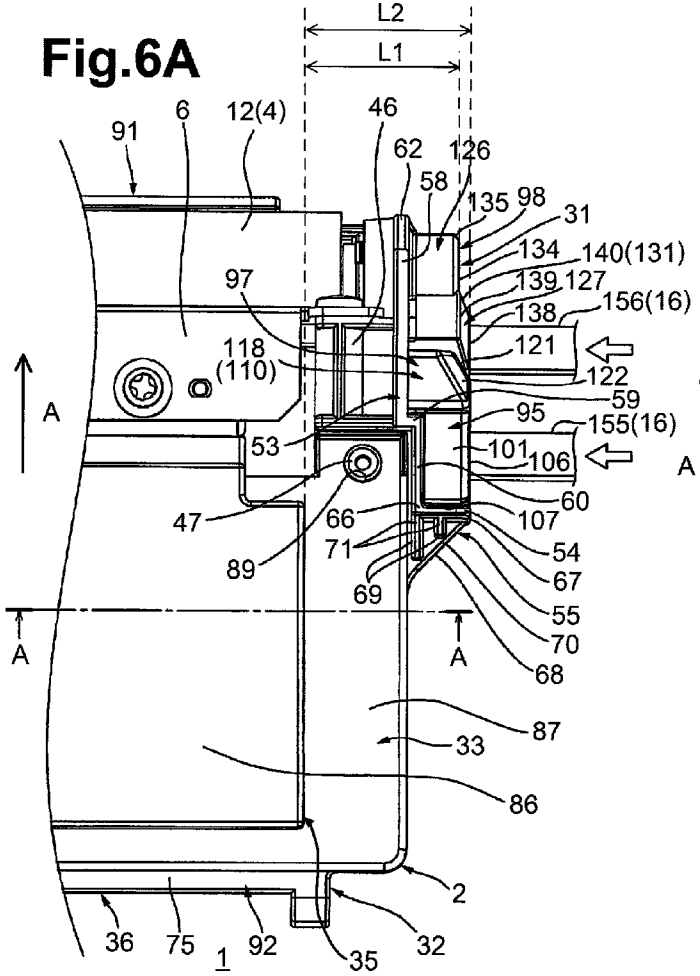
FIG. 6A is a plan view depicting the rightward portion of the developing cartridge installed in the printer depicted in FIG. 2 in the first illustrative embodiment according to one or more aspects of the disclosure.

As depicted in FIGS. 1A and 6A, the developing cartridge 1 includes the developing frame 2 and an electric supply unit 31.

(1) Developing Frame

As depicted in FIGS. 2 and 6B, the developing frame 2 includes a base frame 32 and a cover frame 33.

(1-1) Base Frame

The base frame 32 includes a left side-wall 34, a right side-wall 35, a front wall 36, and a lower wall 37. The right side-wall 35 is an example of a wall portion.

As depicted in FIGS. 1A and 2, the left side-wall 34 and the right side-wall 35 are disposed at both right and left end portions of the developing frame 2. The left side-wall 34 and the right side-wall 35 each have a substantially rectangular plate shape in side view extending in the front-rear direction. That is, the left side-wall 34 and the right side-wall 35 extend in a direction orthogonal to the right-left direction.

Figure 1B:
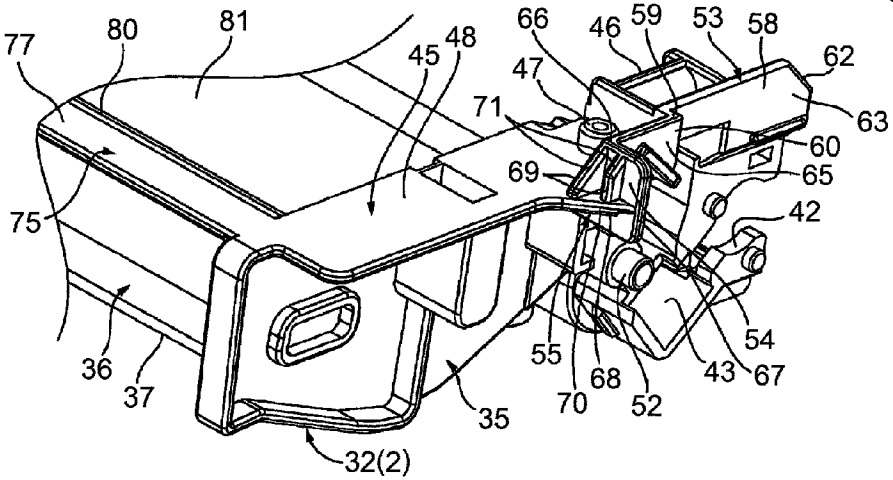
FIG. 1B is a right front perspective view depicting a rightward portion of a base frame depicted in FIG. 1A in the illustrative embodiment according to one or more aspects of the disclosure.
Figure 5B:
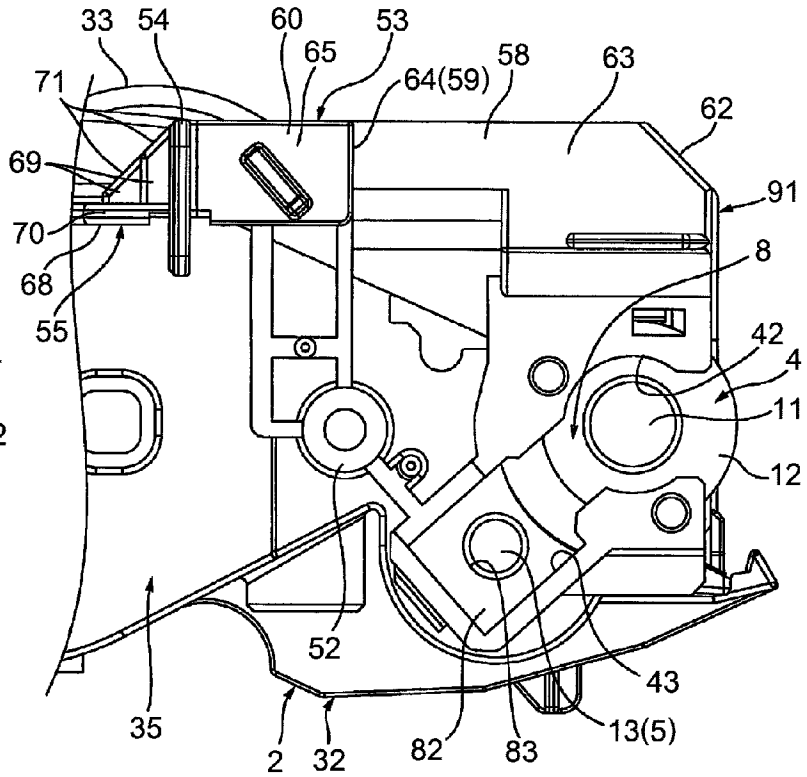
FIG. 5B is a right side view depicting the developing frame depicted in FIG. 5A in the illustrative embodiment according to one or more aspects of the disclosure.

As depicted in FIGS. 1B and 5B, each of the left side-wall 34 and the right side-wall 35 has a pass-through groove 42 for developing-roller shaft, a seal support portion 43, a flange portion 45, a blade support portion 46, and a positioning boss 47.

Figure 3B:
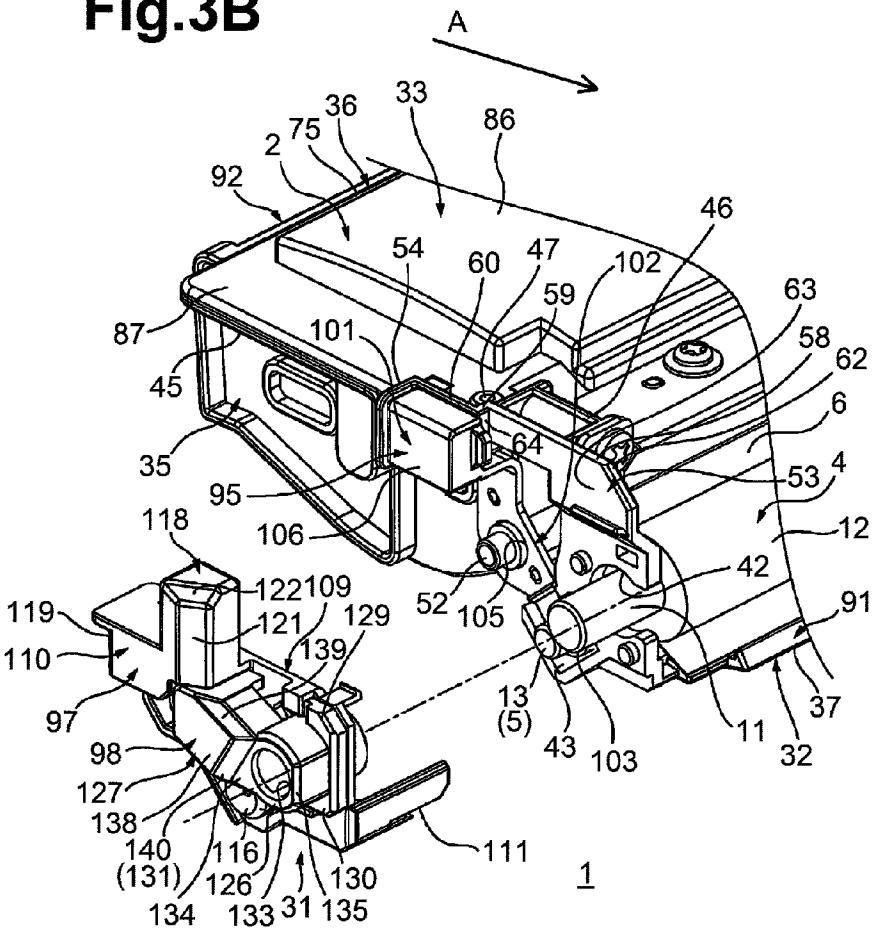
FIG. 3B is a right rear disassembled perspective view depicting an electric supply unit depicted in FIG. 3A in the first illustrative embodiment according to one or more aspects of the disclosure.
Figure 3A:
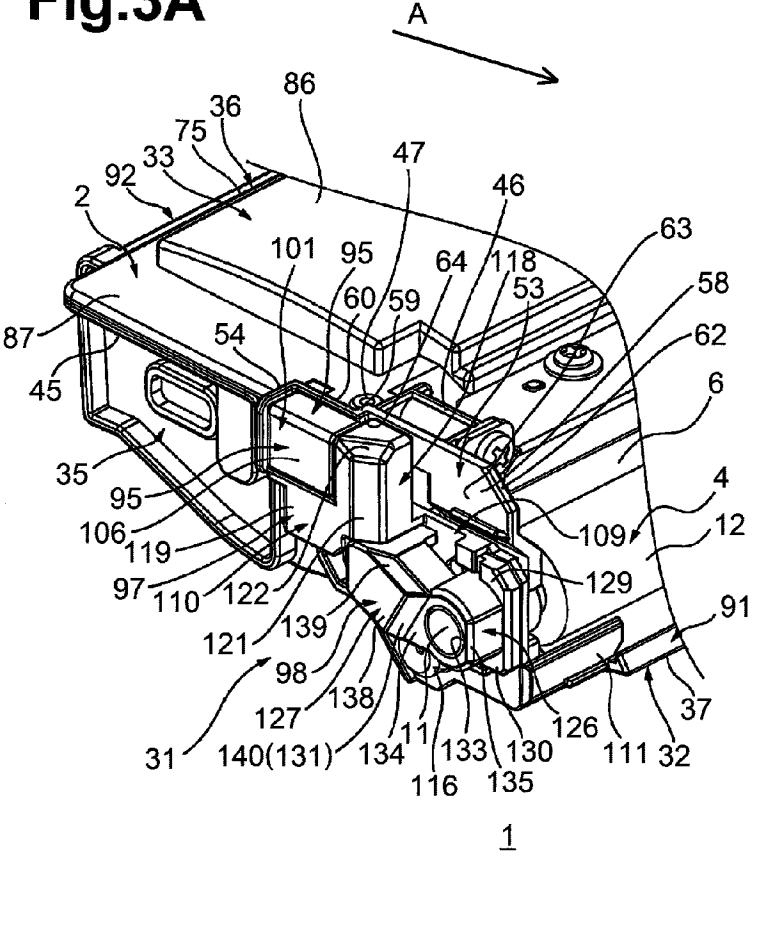
FIG. 3A is a right rear perspective view depicting the rightward portion of developing cartridge depicted in FIG. 1A in the first illustrative embodiment according to one or more aspects of the disclosure.

As depicted in FIGS. 3B and 5B, the pass-through groove 42 is defined in a substantially middle portion of a rear end portion of each of the left side-wall 34 and the right side-wall 35 in the up-down direction. The pass-through grooves 42 each have an end opened to the rear and has a substantially C-shape in side view. The pass-through grooves 42 are recessed toward the front than rear edges of the left side-wall 34 and the right side-wall 35, respectively. An inside diameter of each of the pass-through grooves 42 is larger than a diameter of the shaft portion 11 of the developing roller 4. The shaft portion 11 of the developing roller 4 passes through the pass-through grooves 42.

As depicted in FIG. 5B, in each of the left side-wall 34 and the right side-wall 35, the seal support portion 43 is disposed below and in front of the pass-through groove 42. The seal support portions 43 penetrate the left side-wall 34 and the right side-wall 35, respectively, in the right-left direction. The seal support portions 43 each have a substantially rectangular shape in side view. An inside dimension of each of the seal support portions 43 is larger than an outside diameter of the shaft portion 13 of the supply roller 5.

As depicted in FIG. 1B, in the left side-wall 34 and the right side-wall 35, the flange portions 45 protrude outward from upper end portions of the left side-wall 34 and the right side-wall 35, respectively, in the right-left direction and extend forward from substantially middle portions of the left side-wall 34 and the right side-wall 35, respectively, in the front-rear direction. Upper surface of the flange portions 45 are defined as mating surfaces 48.

As depicted in FIGS. 1A and 1B, in each of the left side-wall 34 and the right side-wall 35, the blade support portion 46 is disposed at an upper-rear end portion thereof. The blade support portions 46 extend upward from rear end portions of the flange portions 45, respectively. The blade support portions 46 each have a substantially rectangular column shape extending in the front-rear direction. The blade support portions 46 each have a threaded hole (not depicted) that is recessed toward the front than a rear end surface of each of the blade support portions 46.

In each of the left side-wall 34 and the right side-wall 35, the positioning boss 47 is disposed at a rear end portion of the flange portion 45. The positioning bosses 47 each have a substantially circular pillar shape. The positioning bosses 47 protrude upward from the mating surfaces 48, respectively.

As depicted in FIGS. 1B and 5B, the right side-wall 35 includes an electrode support shaft 52, a first protruding wall 53, a second protruding wall 54, and a connecting portion 55 that are in one piece.

The electrode support shaft 52 is disposed at a right surface of the right side-wall 35 and above and forward of the seal support portion 43. The electrode support shaft 52 has a substantially circular cylindrical shape. The electrode support shaft 52 extends rightward from the right surface of the right side-wall 35. The electrode support shaft 52 has threads on its inner surface.

The first protruding wall 53 has a substantially plate shape. The first protruding wall 53 protrudes upward from a right end of a rearward portion of the right side-wall 35. As depicted in FIG. 6B, the first protruding wall 53 extends upward therefrom relative to the flange portion 45 of the right side-wall 35 such that its upper end is located at substantially the same position as an upper end of the blade support portion 46 of the right side-wall 35 in the up-down direction. As depicted in FIGS. 1B and 5B, the first protruding wall 53 includes a rearward portion 58, a coupling portion 59, and a forward portion 60.

The rearward portion 58 constitutes a rearward portion of the first protruding wall 53. The rearward portion 58 has a substantially plate shape. The rearward portion 58 protrudes upward from a right end of the rearward portion of the right side-wall 35. The rearward portion 58 includes a chamfered portion 62.

An upper-rear end portion of the rearward portion 58 is removed away to provide the chamfered portion 62.

The rearward portion 58 includes a flat surface 63 on its right surface. The flat surface 63 extends in the front-rear direction and faces toward the right.

As depicted in FIGS. 1B and 3B, the coupling portion 59 constitutes a substantially middle portion of the first protruding wall 53 in the front-rear direction. The coupling portion 59 has a substantially plate shape. The coupling portion 59 extends rightward from a front end of the rearward portion 58.

The coupling portion 59 includes a rear surface 64 that faces toward the rear.

As depicted in FIGS. 1B and 5B, the forward portion 60 constitutes a forward portion of the first protruding wall 53. The forward portion 60 has a substantially plate shape. The forward portion 60 extends forward from a right end of the coupling portion 59.

The forward portion 60 includes a flat surface 65 on its right surface. The flat surface 65 extends in the front-rear direction and faces toward the right.

As depicted in FIG. 6A, when projected in the right-left direction, the rearward portion 58 of the first protruding wall 53 overlaps the blade support portion 46 of the right side-wall 35 and the forward portion 60 of the first protruding wall 53 overlaps the positioning boss 47 of the right side-wall 35.

As depicted in FIGS. 1B and 6B, the second protruding wall 54 is disposed at a substantially middle portion of the right side-wall 35 in the front-rear direction. The second protruding wall 54 has a substantially rectangular plate shape in front view. The second protruding wall 54 extends rightward from a front end of the forward portion 60 of the first protruding wall 53 and protrudes upward in the up-down direction. An upper end of the second protruding wall 54 is located at substantially the same position as the upper end of the first protruding wall 53 in the up-down direction. That is, the upper end of the second protruding wall 54 is located at a position higher than the flange portion 45 of the right side-wall 35.

The second protruding wall 54 includes a left end portion 66 that is joined to the flange portion 45 of the right side-wall 35. The second protruding wall 54 further includes a right end portion 67 opposite to the left end portion 66.

The connecting portion 55 connects the second protruding wall 54 and the right side-wall 35 with each other to reinforce the second protruding wall 54. The connecting portion 55 includes a first rib 68 and a plurality of, for example, two, second ribs 69.

As depicted in FIGS. 1B and 6A, the first rib 68 has a substantially plate shape. The first rib 68 connects a substantially middle portion of a right end of the right flange portion 45 in the front-rear direction and a front surface of the right end portion 67 of the second protruding wall 54 with each other. The first rib 68 extends to the right end of the second protruding wall 54 and thus a right end of the first rig 68 is in contact therewith. The first rib 68 includes a first inclined surface 70 that is inclined rightward toward the rear. That is, the first rib 68 has a substantially triangular shape in plan view.

The second ribs 69 are aligned and spaced apart from each other in the right-left direction. The second ribs 69 each have a substantially plate shape. Each of the second ribs 69 connects an upper surface of the first rib 68 and a front surface of the second protruding wall 54. Each of the second ribs 69 includes a second inclined surface 71 that is inclined upward toward the rear.

More specifically, the left second rib 69 connects the upper surface of a left end portion of the first rib 68 and the front surface of a left end portion of the second protruding wall 54 with each other. That is, the left second rib 69 overlaps the forward portion 60 of the first protruding wall 53 when projected in the front-rear direction. As described above, the left second rib 69 includes the second inclined surface 71, thereby having a substantially triangular shape in side view.

The right second rib 69 connects the upper surface of a substantially middle portion of the first rib 68 in the right-left direction and the upper surface of a substantially middle portion of the second protruding wall 54 in the right-left direction with each other. As described above, the right second rib 69 includes the second inclined surface 71, thereby having a substantially trapezoidal shape in side view.

As depicted in FIG. 1A and FIG. 2, the front wall 36 is disposed between a front end portion of the left side-wall 34 and a front end portion of the right side-wall 35. The front wall 36 has a substantially plate shape extending in the right-left direction. The front wall 36 includes a flange portion 75 and a handle portion 76.

The flange portion 75 extends along an entire upper end portion of the front wall 36 in the right-left direction and protrudes forward therefrom. An upper surface of the flange portion 75 is defined as a mating surface 77.

The handle portion 76 protrudes forward from a substantially middle portion of a front surface of the front wall 36 in the right-left direction.

The lower wall 37 is disposed between a lower end portion of the left side-wall 34 and a lower end portion of the right side-wall 35. The lower wall 37 has a substantially plate shape. As depicted in FIG. 2, the lower wall 37 extends curvedly along the front-rear direction. The lower wall 37 includes a curved wall 80, an arc-shaped wall 81, and seals 82 depicted in FIGS. 5A and 5B.

As depicted in FIG. 2, the curved wall 80 extends between a substantially middle portion of the lower wall 37 and the lower end portion of the front wall 36. The curved wall 80 is contiguous with the lower end portion of the front wall 36 and extends rearward therefrom. The curved wall 80 has a substantially arc shape that is curved along a path along which the agitator 3 rotates.

The arc-shaped wall 81 is disposed at a rearward portion of the lower wall 37 and has a substantially W-letter shape in side view. The arc-shaped wall 81 is contiguous with a rear end of the curved wall 80 and extends rearward therefrom. A forward portion of the arc-shaped wall 81 is curved along a path along which the supply roller 5 rotates. A rearward portion of the arc-shaped wall 81 extends rearward.

Figure 5A:
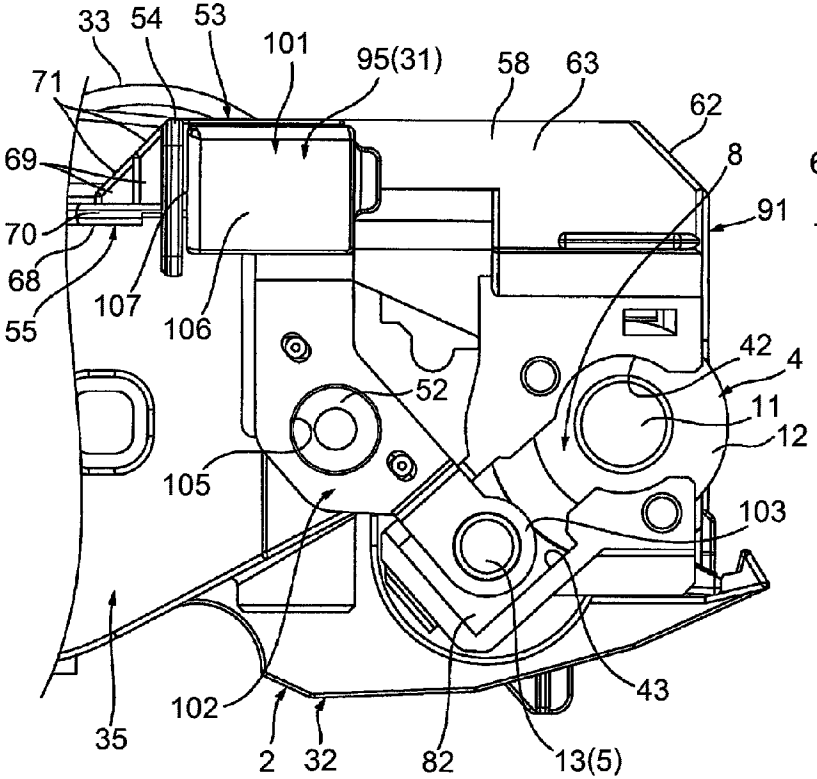
FIG. 5A is a right side view depicting a developing frame in which a supply electrode depicted in FIG. 3B is assembled to its right side-wall in the first illustrative embodiment according to one or more aspects of the disclosure.

As depicted in FIGS. 5A and 5B, the seal 82 are disposed at upper surfaces of right and left end portions, respectively, of the forward portion of the arc-shaped wall 81. The seals 82 are made of an elastic member, for example, a sponge member. The seals 82 each have a substantially rectangular shape in side view extending in the front-rear direction. The seals 82 each have a pass-through hole 83 for supply-roller shaft.

Each of the pass-through holes 83 penetrates a substantially middle portion of a corresponding one of the seals 82 in side view. The pass-through holes 83 each have a circular shape in side view. The pass-through holes 83 are exposed via the respective seal support portions 43 in side view. The pass-through holes 83 are configured to support the supply roller 5 while each of the pass-through holes 83 receives a corresponding one of the right and left end portion of the shaft portion 13 of the supply roller 5 such that the right and left ends of the shaft portion 13 are located outward than the left side-wall 34 and the right side-wall 35, respectively, in the right-left direction.

(1-2) Cover Frame

As depicted in FIGS. 1A and 2, the cover frame 33 includes a convex portion 86, a weld portion 87, and a blade mount portion 88 that are in one piece.

As depicted in FIG. 1A, the convex portion 86 constitutes a substantially middle portion of the cover frame 33 in plan view. The convex portion 86 is curved upward.

For example, three sides of the convex portion 86 are surrounded by the weld portion 87. More specifically, the right, left, and front of the convex portion 86 are surrounded by the weld portion 87. That is, the weld portion 87 has a substantially U-shaped plate shape in plan view. When projected in the up-down direction, a left portion of the weld portion 87 faces the flange portion 45 of the left side-wall 34, a right portion of the weld portion 87 faces the flange portion 45 of the right side-wall 35, and a front portion of the weld portion 87 faces the flange portion 75 of the front wall 36. The weld portion 87 includes a pair of positioning holes 89.

The positioning holes 89 are defined in right and left end portions, respectively, of the weld portion 87. The positioning holes 89 penetrate the weld portion 87 and have a substantially circular shape in plan view. The positioning holes 89 are provided for the positioning bosses 47 of the left side-wall 34 and the right side-wall 35, respectively. The positioning holes 89 each have a size appropriate for receiving the positioning boss 47 of the left side-wall 34 and the positioning boss 47 of the right side-wall 35, respectively.

As depicted in FIG. 2, the blade mount portion 88 has a substantially plate shape. The blade mount portion 88 extends rearward from a rear end of the convex portion 86.

(1-3) Developing Frame

As depicted in FIGS. 1A and 6B, the developing frame 2 consists of the base frame 32 and the cover frame 33.

More specifically, the positioning boss 47 of the left side-wall 34 is disposed in the left positioning hole 89 and the positioning boss 47 of the right side-wall 35 is disposed in the right positioning hole 89, whereby the cover frame 33 is positioned with respect to the base frame 32. Thus, a lower surface of the weld portion 87 of the cover frame 33 contacts an upper end portion of the base frame 32, more specifically, the mating surfaces 48 of the flange portions 45 of the left side-wall 34 and the left side-wall 34 and the mating surface 77 of the flange portion 75 of the front wall 36 and is welded thereto. As described above, the cover frame 33 is assembled to the base frame 32.

In the developing frame 2 structured as described above, an end portion thereof in the front-rear direction at which the developing roller 4 is disposed, e.g., a rear end portion of the developing frame 2, is referred to as a first end portion 91, and an end portion thereof in the front-rear direction at which the handle portion 76 is disposed and that is opposite to the first end portion 91 in the front-rear direction is referred to as a second end portion 92.

As depicted in FIG. 2, a space, i.e., the toner chamber 7, is defined in a forward portion of the developing frame 2 by a forward portion of the left side-wall 34, a forward portion of the right side-wall 35, the front wall 36, the curved wall 80 of the lower wall 37, and the convex portion 86 of the cover frame 33. Another space, i.e., the developing chamber 8, is defined in a rearward portion of the developing frame 2 by a rearward portion of the left side-wall 34, a rearward portion of the right side-wall 35, the arc-shaped wall 81 of the lower wall 37, and the blade mount portion 88 of the cover frame 33.

(2) Electric Supply Unit

As depicted in FIGS. 3A and 3B, the electric supply unit 31 includes a supply electrode 95, an insulation member 97, and a developing electrode 98.

(2-1) Supply Electrode

As depicted in FIGS. 3B and 5A, the supply electrode 95 is made of a conductive resin material, for example, conductive polyoxymethylene (POM) also known as polyacetal. The supply electrode 95 is configured to electrically connect with the supply roller 5. The supply electrode 95 extends obliquely downward toward the rear in side view. The supply electrode 95 includes a contact portion 101, a fixing portion 102, and a pass-through portion 105 that are in one piece. The contact portion 101 is an example of a third contact portion.

The contact portion 101 is configured to contact with a first body-casing electrode 155 of the body casing 16 of the printer 15. The contact portion 101 is disposed at an upper end portion of the supply electrode 95. The contact portion 101 has a substantially rectangular cylindrical shape with its right end closed. The contact portion 101 extends in the right-left direction. A right surface of the contact portion 101 is defined as a contact surface 106. A front surface of the contact portion 101 is defined as a flat surface 107.

The fixing portion 102 has a substantially L-shaped plate shape in side view. More specifically, the fixing portion 102 is contiguous with a lower-left end portion of the contact portion 101 and is curved at an appropriate portion to extend downward. The fixing portion 102 has a first through hole 105.

The first through hole 105 is disposed at a substantially middle portion of the fixing portion 102 in the up-down direction. The first through hole 105 penetrates the fixing portion 102 and has a substantially circular shape in side view. An inside diameter of the first through hole 105 is larger than an outside diameter of the electrode support shaft 52 of the right side-wall 35.

As depicted in FIG. 5A, the pass-through portion 105 is disposed at a lower end portion of the supply electrode 95. The pass-through portion 105 has a substantially circular cylindrical shape extending in the right-left direction. An inside diameter of the pass-through portion 105 is substantially the same as an outside diameter of the shaft portion 13 of the supply roller 5.

(2-2) Insulation Member

Figure 4:
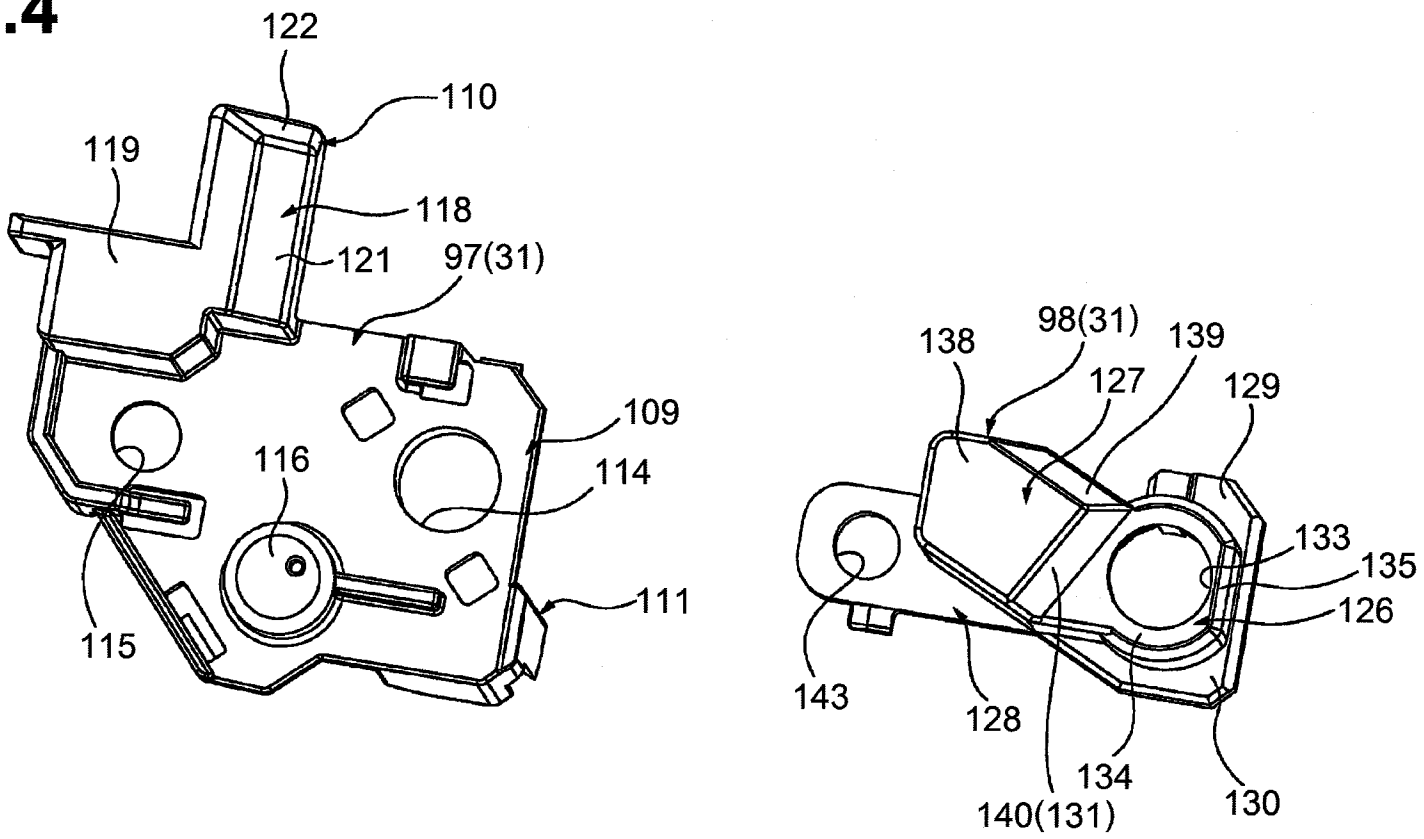
FIG. 4 is a right rear perspective view depicting an insulation member and a developing electrode depicted in FIG. 3B in the first illustrative embodiment according to one or more aspects of the disclosure.

As depicted in FIG. 4, the insulation member 97 is made of a conductive resin material, for example, conductive polyoxymethylene (POM) also known as polyacetal. The insulation member 97 is configured to interrupt establishment of an electrical connection between the supply electrode 95 and the developing electrode 98. The insulation member 97 includes a bearing portion 109, a protector 110, and an engagement portion 111 that are in one piece.

The bearing portion 109 has a substantially rectangular plate shape in side view and extends both in the up-down direction and in the front-rear direction. The bearing portion 109 includes a pass-through hole 114, a second through hole 115, and a collar 116. The pass-through hole 114 is configured to allow the shaft portion 11 of the developing roller 4 to pass therethrough. The collar 116 is configured to receive the shaft portion 13 of the supply roller 5.

The pass-through hole 114 is disposed at a substantially middle portion of a rearward portion of the bearing portion 109 in the up-down direction. The pass-through hole 114 penetrates the bearing portion 109 and has a substantially circular shape in side view. An inside diameter of the pass-through hole 114 is substantially the same as the outside diameter of the shaft portion 11 of the developing roller 4.

The second through hole 115 is disposed at a substantially middle portion of a forward portion of the bearing portion 109 in the up-down direction. The second through hole 115 penetrates the bearing portion 109 and has a substantially circular shape in side view. An inside diameter of the second through hole 115 is substantially the same as an outside diameter of the electrode support shaft 52.

The collar 116 is disposed at a lower portion of a substantially middle portion of the bearing portion 109 in the front-rear direction. The collar 116 protrudes rightward from a right surface of the bearing portion 109. The collar 116 has a substantially circular cylindrical shape with its right end closed. An inside diameter of the collar 116 is substantially the same as the outside diameter of the shaft portion 13 of the supply roller 5.

The protector 110 is disposed at an upper-front end portion of the insulation member 97. The protector 110 has a substantially L-shape in side view. The protector 110 extends in the right-left direction. The protector 110 has a substantially polygonal-cylindrical shape with its right end closed. The protector 110 includes a first protector portion 118 and a second protector portion 119 that are in one piece.

The first protector portion 118 is disposed at a rearward portion of the protector 110. The first protector portion 118 has a substantially rectangular shape in side view extending in the up-down direction. A lower-right end portion of the first protector portion 118 is contiguous with an upper end portion of the bearing portion 109.

A rear-right end portion of the first protector portion 118 is inclined rightward toward the front and thus the first protector portion 118 includes a first inclined guide surface 121. The first guide surface 121 is an example of a fourth inclined surface. That is, the first guide surface 121 extends in a direction away from the right side-wall 35.

A rightward portion of an upper end portion of the first protector portion 118 is inclined rightward toward the front and thus the first protector portion 118 further includes a second inclined guide surface 122. The second guide surface 122 is an example of a fifth inclined surface. That is, the second guide surface 122 and the first guide surface 121 face different directions respectively.

An upper end of the first guide surface 121 and a lower end of the second guide surface 122 are contiguous with each other.

A forward portion of the protector 110 serves as the second protector portion 119. The second protector portion 119 has a substantially rectangular shape in side view extending in the front-rear direction. A rear end portion of the second protector portion 119 is contiguous with a lower end portion of the first protector portion 118. A left end portion of a lower portion of the second protector portion 119 is contiguous with an upper-front end portion of the bearing portion 109.

The engagement portion 111 is disposed at a lower-rear end portion of a left surface of the bearing portion 109. The engagement portion 111 protrudes leftward from the bearing portion 109 and has a substantially L-shape in side view.

(2-3) Developing Electrode

The developing electrode 98 is made of a conductive resin material, for example, conductive polyoxymethylene (POM) also known as polyacetal. The developing electrode 98 is configured to electrically connect with developing roller 4. The developing electrode 98 includes a covering portion 126, a contact portion 127, a connecting portion 131, a flat-plate portion 128, an upper extended portion 129, and a lower extended portion 130. The covering portion 126 is an example of a first contact portion. The contact portion 127 is an example of a second contact portion.

The covering portion 126 is configured to contact the shaft portion 11 of the developing roller 4 and cover an entire portion of the peripheral surface of the shaft portion 11 of the developing roller 5. The covering portion 126 is disposed at a substantially middle portion of the rearward portion of the developing electrode 98 in the up-down direction. The covering portion 126 has thickness in the right-left direction and has a substantially rectangular thick-plate shape in side view. The covering portion 126 includes a pass-through hole 133 for developing-roller shaft.

The pass-through hole 133 penetrates a substantially middle portion of the covering portion 126 and has a substantially circular shape in side view. An inside diameter of the pass-through hole 133 is substantially the same as the outside diameter of the shaft portion 11 of the developing roller 4.

A right surface, not including the pass-through hole 133, of the covering portion 126 serves as a flat surface 134. The flat surface 134 is an example of a first flat surface. The flat surface 134 extends evenly along the front-rear direction. The flat surface 134 is separated from the right side-wall 35 by a first distance L1 in the right-left direction.

A right end portion of a rearward portion of the covering portion 126 is inclined leftward toward the front and thus the covering portion 126 has a first inclined guide surface 135. The first guide surface 135 is an example of a second inclined surface. That is, a front end of the first guide surface 135 is contiguous with a rear end of the flat surface 134. In other words, the first guide surface 135 is defined at another end portion of the covering portion 126 that is opposite to the connecting portion 131.

The contact portion 127 is disposed as a substantially middle portion of the developing electrode 98 in the front-rear direction. The contact portion 127 is disposed in front of the covering portion 126 and is adjacent to the covering portion 126. The contact portion 127 protrudes more leftward than the covering portion 126. The contact portion 127 has a substantially polygonal cylindrical shape with its right end closed.

A right surface of the contact portion 127 serves as a flat surface 138, which is an example of a second flat surface. The flat surface 138 of the contact portion 127 extends parallel to the flat surface 134 of the covering portion 126. That is, the flat surface 138 of the contact portion 127 extends evenly along the front-rear direction. The flat surface 138 of the contact portion 127 is located more rightward than the flat surface 134 of the covering portion 126. For example, the flat surface 138 of the contact portion 127 is located in a range between 0.5 mm or more, preferably 1.0 mm or more, and 5.0 mm or less, preferably 2.0 mm or less further toward the right than the flat surface 134 of the covering portion 126. More specifically, the flat surface 138 of the contact portion 127 is located 1.4 mm further toward the right than the flat surface 134 of the covering portion 126. The flat surface 138 is separated from the right side-wall 35 by a second distance L2 in the right-left direction. The first distance L1 is smaller than the second distance L2.

The contact portion 127 includes a second guide surface 139 at an upper-rear end portion thereof. The second guide surface 139 extends obliquely toward the lower rear and is inclined rightward toward the lower front. The second guide surface 139 is an example of a third inclined surface.

The connecting portion 131 is disposed between the covering portion 126 and the contact portion 127 in the front-rear direction to connect the covering portion 126 and the contact portion 127 with each other. The connecting portion 131 extends obliquely upward toward the rear. That is, the connecting portion 131 extends in a direction substantially orthogonal to the installation direction A of the developing cartridge 1 into the printer 15.

The connecting portion 131 includes a guide surface 140 that is inclined rightward toward the upper front. That is, the guide surface 140 of the connecting portion 131 extends in a direction away from the right side-wall 35. The guide surface 140 of the connecting portion 131 is an example of a first inclined surface.

The guide surface 140 of the connecting portion 131 faces a direction that is different from the directions that the first guide surface 121, the second guide surface 122, the first guide surface 135, and the second guide surface 139 face respectively. A dimension in the up-down direction of the guide surface 140 of the connecting portion 131 is shorter than a dimension in the up-down direction of the first guide surface 121 of the first protector portion 118. An angle which the guide surface 140 of the connecting portion 131 forms with the right side-wall 35 is smaller than an angle which the first guide surface 121 forms with the right side-wall 35.

A forward portion of the developing electrode 98 serves as the flat-plate portion 128. The flat-plate portion 128 extends forward from a lower front portion of a left end portion of the contact portion 127 and has a substantially rectangular plate shape in side view. The flat-plate portion 128 has a third through hole 143.

The third through hole 143 is defined in a forward portion of the flat-plate portion 128. The third through hole 143 penetrates the flat-plate portion 128 and has a substantially circular shape in side view. An inside diameter of the third through hole 143 is substantially the same as the outside diameter of the electrode support shaft 52.

The upper extended portion 129 extends upward from an upper-left end portion of the covering portion 126 and has a substantially rectangular plate shape in side view.

The lower extended portion 130 extends downward from a lower-left end portion of the covering portion 126 and has a substantially rectangular plate shape in side view.

(2-4) Assembling of Supply Electrode, Insulation Member, and Developing Electrode As depicted in FIGS. 3B and 5A, the supply electrode 95 is positioned with respect to the right side-wall 35 while the first through hole 105 receives the electrode support shaft 52 therein and the pass-through portion 105 receives a right end portion of the shaft portion 13 of the supply roller 5.

In this state, as depicted in FIGS. 5A and 5B, the contact portion 101 of the supply electrode 95 overlaps the forward portion 60 of the first protruding wall 53 when projected in the right-left direction. As depicted in FIGS. 3B and 6A, the flat surface 107 of the contact portion 101 faces a rear surface of the second protruding wall 54. More specifically, the second protruding wall 54 covers an entire portion of the flat surface 107 of the contact portion 101 of the supply electrode 95. In other words, the contact portion 101 is spaced apart from the shaft portion 13 of the supply roller 5 in the front-rear direction.

As depicted in FIGS. 3B and 4, the developing electrode 98 is assembled to the insulation member 97 from the right of the insulation member 97 in side view such that the third through hole 143 of the developing electrode 98 overlaps the second through hole 115 of the insulation member 97 and the pass-through hole 133 of the developing electrode 98 overlaps the pass-through hole 114 of the insulation member 97.

The insulation member 97 and the developing electrode 98 that are assembled to each other are further assembled to the right side-wall 35 in which the supply electrode 95 is positioned. More specifically, both the third through hole 143 of the developing electrode 98 and the second through hole 115 of the insulation member 97 receive the electrode support shaft 52 therein, both the pass-through hole 133 of the developing electrode 98 and the pass-through hole 114 of the insulation member 97 receive the right end portion of the shaft portion 11 of the developing roller 4, and the collar 116 of the insulation member 97 receives the right end portion of the shaft portion 13 of the supply roller 5. The engagement portion 111 is in contact with a right-rear end portion of the lower wall 37 of the developing frame 2 from the lower below.

As described above, as depicted in FIG. 3A, the insulation member 97 and the developing electrode 98 are positioned with respect to the right side-wall 35.

The supply electrode 95, the insulation member 97, and the developing electrode 98 are fixed to the right side-wall 35 using the electrode support shaft 52 that screwed into the supply electrode 95, the insulation member 97, and the developing electrode 98. That is, the supply electrode 95, the insulation member 97, and the developing electrode 98 are disposed adjacent to each other in the right-left direction.

In this state, the first protector portion 118 of the insulation member 97 is disposed behind and adjacent to the contact portion 101 of the supply electrode 95, and the second protector portion 119 of the insulation member 97 is disposed below and adjacent to the contact portion 101 of the supply electrode 95. That is, the first protector portion 118 and the second protector portion 119 are configured to protect the contact portion 101 of the supply electrode 95.

The first protector portion 118 of the insulation member 97 is disposed above and adjacent to the contact portion 127 of the developing electrode 98, and the second protector portion 119 of the insulation member 97 is disposed in front of and adjacent to the contact portion 127 of the developing electrode 98. That is, the first protector portion 118 and the second protector portion 119 are configured to protect the contact portion 127 of the developing electrode 98.

A right end surface of the shaft portion 11 of the developing roller 4 is flush with the flat surface 134 of the developing electrode 98.

A left end portion of the first protector portion 118 of the insulation member 97 faces the coupling portion 59 of the first protruding wall 53 in the front-rear direction.

4. Details of Process Cartridge

The process cartridge 17 includes the drum cartridge 24 and the developing cartridge 1 that is attached to the drum cartridge 24.

Figure 7B:
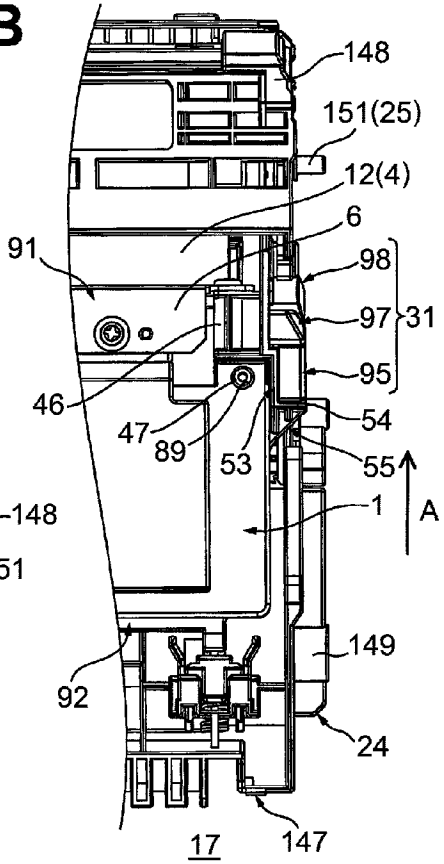
FIG. 7B is a plan view depicting the rightward portion of the process cartridge depicted in FIG. 7A in the first illustrative embodiment according to one or more aspects of the disclosure.
Figure 7A:
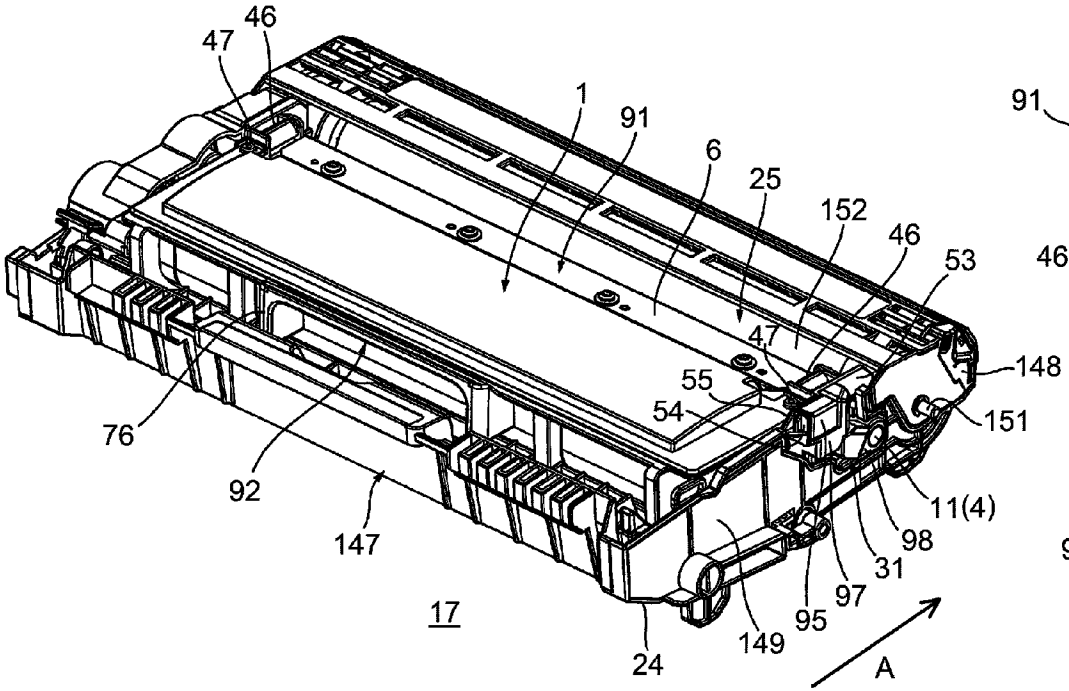
FIG. 7A is a right front perspective view depicting a process cartridge depicted in FIG. 2 in the illustrative embodiment according to one or more aspects of the disclosure.

As depicted in FIGS. 2 and 7A, the drum cartridge 24 includes a drum frame 147, the photosensitive drum 25, and the scorotron charger 26.

The drum frame 147 has a substantially rectangular frame shape with its lower end closed. The drum frame 147 includes a drum accommodating portion 148 at its rearward portion and a developing-cartridge accommodating portion 149 at its forward portion.

The drum accommodating portion 148 supports the photosensitive drum 25 and the scorotron charger 26.

As depicted in FIGS. 7A and 7B, the photosensitive drum 25 includes a drum shaft 151 and a drum body 152. Both right and left end portions of the drum shaft 151 protrude to the outside beyond right and left ends, respectively, of the drum accommodating portion 148 in the right-left direction. The drum body 152 covers a substantially middle portion of the drum shaft 151 in the right-left direction.

The developing-cartridge accommodating portion 149 is configured to allow the developing cartridge 1 to be attached thereto and to be detached therefrom.

In a state where the developing cartridge 1 is attached to the developing-cartridge accommodating portion 149 of the drum frame 147, as depicted in FIG. 2, a rear end portion of the body portion 12 of the developing roller 4 is in contact with a front end portion of the drum body 152 of the photosensitive drum 25. The electric supply unit 31 is located to the left of a right end portion of the drum shaft 151 and to the right of a right wall of the drum frame 147.

As described above, the process cartridge 17 is assembled.

5. Details of Body Casing

As depicted in FIG. 6A, the body casing 16 includes a first body-casing electrode 155 and a second body-casing electrode 156. Each of the first body-casing electrode 155 and the second body-casing electrode 156 are an example of an apparatus electrode.

The first body-casing electrode 155 is disposed such that the first body-casing electrode 155 is in contact with the contact surface 106 of the contact portion 101 of the supply electrode 95 in the right-left direction in a state where the developing cartridge 1 is installed in the body casing 16. The first body-casing electrode 155 is configured to be movable along the right-left direction and is urged toward the left at all times. The first body-casing electrode 155 is electrically connected with a power source (not depicted) disposed at the body casing 16.

The second body-casing electrode 156 is disposed such that the second body-casing electrode 156 is in contact with the flat surface 138 of the contact portion 127 of the developing electrode 98 in the right-left direction in the state where the developing cartridge 1 is installed in the body casing 16. The second body-casing electrode 156 is configured to be movable along the right-left direction and is urged toward the left at all times. The second body-casing electrode 156 is electrically connected with a power source (not depicted) disposed at the body casing 16.

6. Installing and Removing Developing Cartridge into and from Body Casing

Referring to FIGS. 7A to 9B, installation and removal procedures of the developing cartridge 1 with respect to the body casing 16 will be described below.

To install the developing cartridge 1 into the body casing 16, as depicted in FIGS. 7A and 7B, an operator places the developing cartridge 1 in the developing-cartridge accommodating portion 149 of the drum cartridge 24 to form the process cartridge 17.

Then, as depicted in FIG. 2, the operator opens the front cover 21 to insert the process cartridge 17 into the body casing 16 via the opening 20.

Figure 8A:
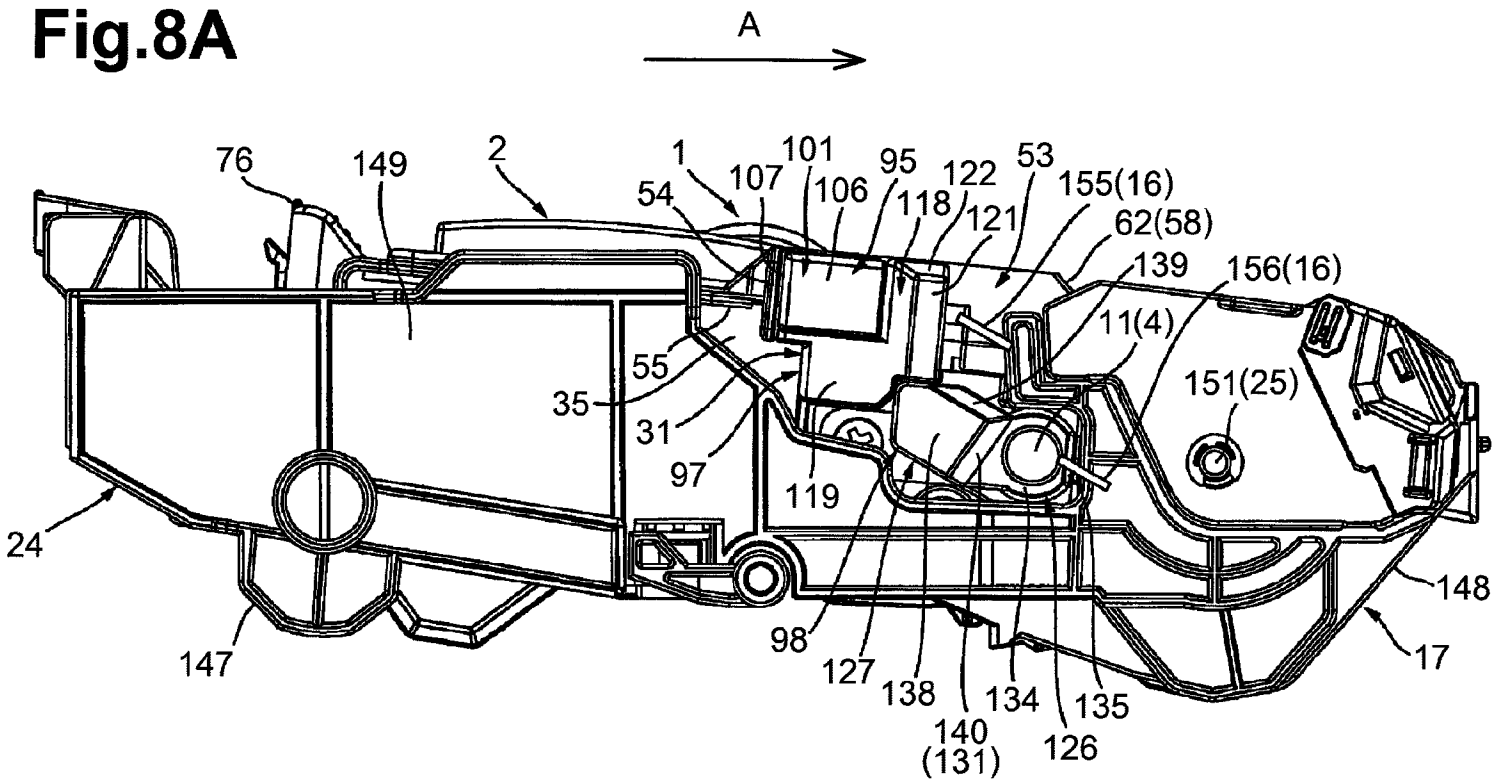
FIG. 8A is a diagram for explaining installation and removal procedures of the process cartridge depicted in FIG. 7A with respect to the printer in the first illustrative embodiment according to one or more aspects of the disclosure, wherein a first body-casing electrode is located rearward of the insulation member and a second body-casing electrode is in contact with the developing electrode.

Thus, as depicted in FIG. 8A, the first body-casing electrode 155 of the body casing 16 is located rearward of the first protector portion 118 of the insulation member 97.

Further, the second body-casing electrode 156 of the body casing 16 is in contact with the covering portion 126 of the developing electrode 98. During the insertion of the process cartridge 17, the second body-casing electrode 156 moves rightward while being guided by the first guide surface 135 of the covering portion 126 and sliding against the first guide surface 135.

As the operator inserts the process cartridge 17 further into the body casing 16, as depicted in 8B, the first body-casing electrode 155 of the body casing 16 comes into contact with the first protector portion 118 of the insulation member 97. During the insertion of the process cartridge 17, the first body-casing electrode 155 moves rightward while being guided by the first guide surface 121 of the first protector portion 118 and sliding against the first guide surface 121.

Meanwhile, the second body-casing electrode 156 moves forward relative to the process cartridge 17 while sliding against the flat surface 134 of the covering portion 126 and the right end surface of the shaft portion 11 of the developing roller shaft 4.

Figure 9A:
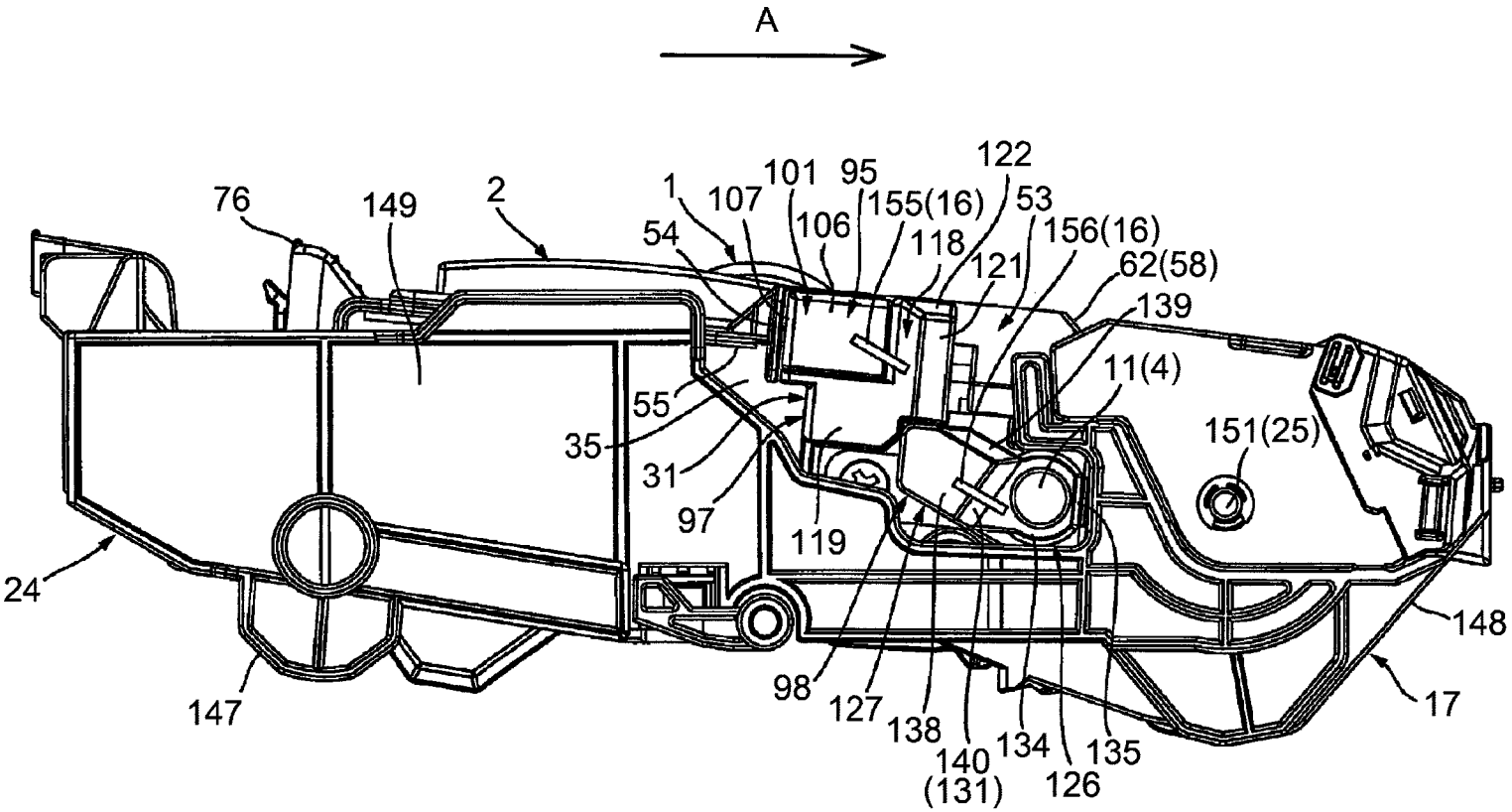
FIG. 9A is a diagram for explaining the installation and removal procedures of the process cartridge depicted with respect to the printer, subsequent to a step of FIG. 8B in the first illustrative embodiment according to one or more aspects of the disclosure, wherein first body-casing electrode slides against the insulation member and the supply electrode and the second body-casing electrode is in contact with a connecting portion of the developing electrode.

While the process cartridge 17 is inserted further into the body casing 16, as depicted in FIG. 9A, the first body-casing electrode 155 moves forward relative to the process cartridge 17 while sliding against the right surface of the first protector portion 118 and the contact surface 106 of the contact portion 101 of the supply electrode 95.

Meanwhile, the second body-casing electrode 156 comes into contact with the connecting portion 131 of the developing electrode 98. The second body-casing electrode 156 moves rightward while being guided by the guide surface 140 of the connecting portion 131 and sliding against the guide surface 140 of the connecting portion 131.

Figure 9B:
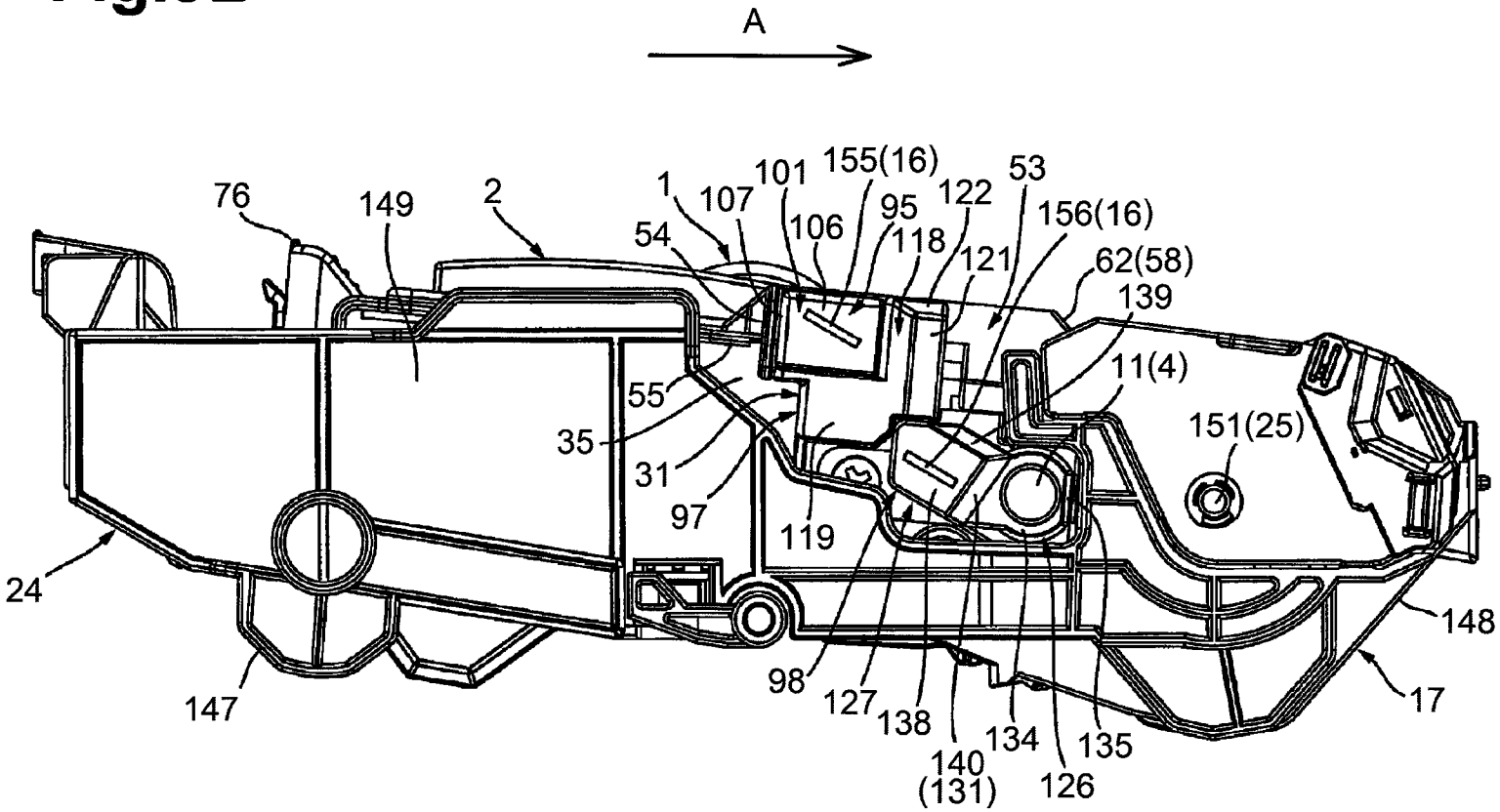
FIG. 9B is a diagram for explaining the installation and removal procedures of the process cartridge depicted with respect to the printer, subsequent to a step of FIG. 9A in the first illustrative embodiment according to one or more aspects of the disclosure, wherein the first body-casing electrode is in contact with the supply electrode and the second body-casing electrode is in contact with the developing electrode.

While the process cartridge 17 is inserted further into the body casing 16, as depicted in FIG. 9B, the first body-casing electrode 155 comes into contact with the contact surface 106 of the contact portion 101 from the right.

Meanwhile, the second body-casing electrode 156 also comes into contact with the flat surface 138 of the contact portion 127 from the right.

Thus, the installation of the process cartridge 17 into the body casing 16 is completed.

To remove the developing cartridge 1 from the body casing 16, the operator reverses the installation procedure.

More specifically, as depicted in FIG. 2, the operator opens the front cover 21 and pulls the process cartridge 17 forward via the opening 20.

Then, the operator removes the developing cartridge 1 from the developing-cartridge accommodating portion 149 of the drum cartridge 24. Thus, the removal procedure is completed.

7. Effects (1) According to the developing cartridge 1, as depicted in FIG. 9A, during installation of the process cartridge 17 including the developing cartridge 1 into the body casing 16, the developing cartridge 1 is inserted into the body casing 16 while the guide surface 140 of the connecting portion 131 of the connecting portion 131 guides the second body-casing electrode 156 to move the second body-casing electrode 156 gradually apart from the right side-wall 35.

Therefore, this configuration may reduce an impact caused when the developing electrode 98 comes into contact with the second body-casing electrode 156 of the body casing 16 in the front-rear direction, whereby the developing cartridge 1 may be installed into the body casing 16 smoothly.

Thus, the covering portion 126 that is in contact with the shaft portion 11 of the developing roller 4 and the contact portion 127 that is configured to come into contact with the second body-casing electrode 156 are aligned along the installation direction A. Therefore, this configuration may enable appropriate contact of the developing electrode 98 to the second body-casing electrode 156 while the size of the developing cartridge 1 is reduced in the up-down direction.

Figure 8B:
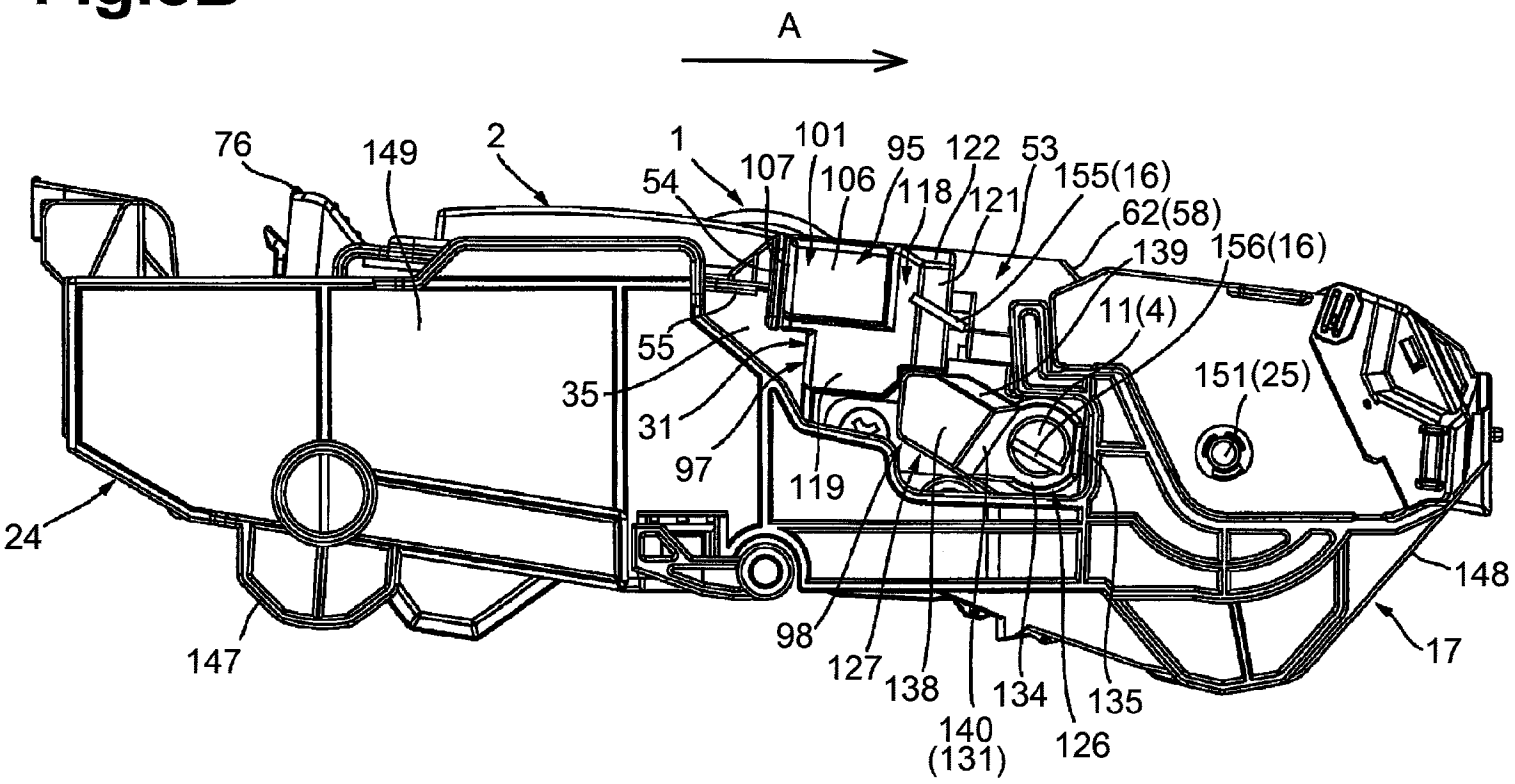
FIG. 8B is a diagram for explaining the installation and removal procedures of the process cartridge depicted with respect to the printer, subsequent to a step of FIG. 8A in the illustrative embodiment according to one or more aspects of the disclosure, wherein the first body-casing electrode is in contact with the first insulation member and the second body-casing electrode slides against the developing electrode.

(2) According to the developing cartridge 1, as depicted in FIG. 8B, the flat surface 134 of the covering portion 126 extends evenly in the front-rear direction. This configuration, therefore, may reduce resistance caused by a rub between the second body-casing electrode 156 and the covering portion 126 during the installation of the developing cartridge 1 into the body casing 16.

(3) According to the developing cartridge 1, as depicted in FIG. 6A, in the developing electrode 98, the flat surface 138 of the contact portion 127 is located 1.4 mm further toward the right than the flat surface 134 of the covering portion 126.

Therefore, while reducing resistance caused by a rub between the second body-casing electrode 156 and each of the covering portion 126 and the contact portion 127, this configuration may ensure reliable contact between the flat surface 138 of the contact portion 127 of the developing electrode 98 and the second body-casing electrode 156.

(4) According to the developing cartridge 1, as depicted in FIG. 8B, when the second body-casing electrode 156 is made contact with the covering portion 126 of the developing electrode 98, the second body-casing electrode 156 may slide smoothly against the flat surface 134 of the covering portion 126 and the right end surface of the shaft portion 11 of the developing roller 4.

Therefore, resistance caused by a rub between the second body-casing electrode 156 and the shaft portion 11 of the developing roller 4 may be reduced.

Consequently, damage to the shaft portion 11 of the developing roller 4 and the second body-casing electrode 156 may be reduced or prevented.

(5) According to the developing cartridge 1, as depicted in FIG. 8A, the first guide surface 135 may guide the second body-casing electrode 156 to the flat surface 134 during the installation of the developing cartridge 1 to the body casing 16.

Therefore, this configuration may reduce an impact caused when the covering portion 126 including the flat surface 134 comes into contact with one of the first body-casing electrode 155 and the second body-casing electrode 156 of the body casing 16 into the front-rear direction, whereby the developing cartridge 1 may be installed in the body casing 16 further smoothly.

(6) According to the developing cartridge 1, as depicted in FIG. 8A, even when the developing cartridge 1 is inserted into the body casing 16 with skewing during the installation of the developing cartridge 1 to the body casing 16, the second guide surface 139 of the contact portion 127 may guide the second body-casing electrode 156 toward the flat surface 138 of the contact portion 127 in the developing electrode 98.

Therefore, this configuration may ensure appropriate contact between the flat surface 138 and the second body-casing electrode 156 while enabling smooth installation of the developing cartridge 1 into the body casing 16.

(7) According to the developing cartridge 1, as depicted in FIGS. 3A and 3B, the contact portion 101 of the supply electrode 95, which is configured to be electrically connected to the shaft portion 13 of the supply roller 5, the contact portion 127 of the developing electrode 98, which is configured to be electrically connected to the shaft portion 11 of the developing roller shaft 4, and the insulation member 97, which is configured to interrupt establishment of an electrical connection between the supply electrode 95 and the developing electrode 98 may be aligned along the installation direction A.

Therefore, while establishment of an electrical connection between the supply electrode 95 and the developing electrode 98 is interrupted by the insulation member 97 that is disposed between the contact portion 127 of the developing electrode 98 and the contact portion 101 of the supply electrode 95, the size of the developing cartridge 1 in the up-down direction may be reduced, thereby reducing the thickness of the developing cartridge 1.

(8) According to the developing cartridge 1, as depicted in FIG. 8B, during the installation of the developing cartridge 1 into the body casing 16, the first guide surface 121 of the insulation member 97 may guide the first body-casing electrode 155 toward the supply electrode 95.

Therefore, during the installation of the developing cartridge 1 into the body casing 16, the first body-casing electrode 155 may be guided to the supply electrode 95 and may be surely made in contact therewith.

(9) According to the developing cartridge 1, as depicted in FIGS. 6A and 8B, the developing cartridge 1 may be installed into the body casing 16 while the first guide surface 121 guides the first body-casing electrode 155 to move the first body-casing electrode 155 gradually apart from the right side-wall 35.

(10) According to the developing cartridge 1, as depicted in FIG. 8A, during the installation of the developing cartridge 1 into the body casing 16, even when the developing cartridge 1 is inserted into the body casing 16 with skewing, the second guide surface 122 may guide the first body-casing electrode 155 toward the supply electrode 95.

With this configuration, the developing cartridge 1 may be installed into the body casing 16 smoothly and the supply electrode 95 may be surely made contact with one of the first body-casing electrode 155 and the second body-casing electrode 156.

(11) According to the developing cartridge 1, as depicted in FIGS. 8A and 8B, the first body-casing electrode 155 and the second body-casing electrode 156 slide against the respective guide surfaces having the different inclination angles. Therefore, an impact caused when the first body-casing electrode 155 and the second body-casing electrode 156 come into contact with the developing cartridge 1 may be scattered.

Therefore, the developing cartridge 1 may be installed into the body casing 16 smoothly.

(12) According to the developing cartridge 1, as compared with a case where the first guide surface 121 guides the first body-casing electrode 155 toward the supply electrode 95 as depicted in FIG. 6A, the guide surface 140 of the connecting portion 131 may guide the second body-casing electrode 156 toward the developing electrode 98 more smoothly.

(13) According to the developing cartridge 1, as depicted in FIG. 8A, during installation of the process cartridge 17 including the developing cartridge 1 into the body casing 16, an upstream portion of the process cartridge 17 in the installation direction A may rotate in the up-down direction on a downstream portion of the process cartridge 17. In the developing cartridge 1, the first guide surface 121 is disposed further to the upstream than the first guide surface 135 in the installation direction A. Thus, during installation of the process cartridge 17 including the developing cartridge 1 into the body casing 16, degree that the first guide surface 121 rotates greater than degree that the guide surface 140 of the connecting portion 131 rotates.

In this illustrative embodiment, the dimension of the first guide surface 121 in the up-down direction is longer than the dimension of the first guide surface 135 in the up-down direction. With this configuration, even when the developing cartridge 1 rotates as described above, the first body-casing electrode 155 and the second body-casing electrode 156 may surely be guided.

(14) According to the developing cartridge 1, as depicted in FIG. 3A, the supply electrode 95 and the developing electrode 98 are made of a conductive resin material. Therefore, while both the supply electrode 95 and the developing electrode 98 are molded easily, both the supply electrode 95 and the developing electrode 98 may surely supply electric power to the developing roller 4 and the supply roller 5.

(15) According to the process cartridge 17, as depicted in FIG. 7B, the drum shaft 151 of the drum cartridge 24 is disposed further toward the right than the developing electrode 98 of the developing cartridge 1. Therefore, during installation of the process cartridge 17 into the body casing 16, this configuration may prevent or reduce a contact of the developing electrode 98 to members disposed in the body casing 16.

Therefore, while the developing electrode 98 is protected, the process cartridge 17 including the developing cartridge 1 may be installed into the body casing 16.

8. Second Illustrative Embodiment

Figure 10:
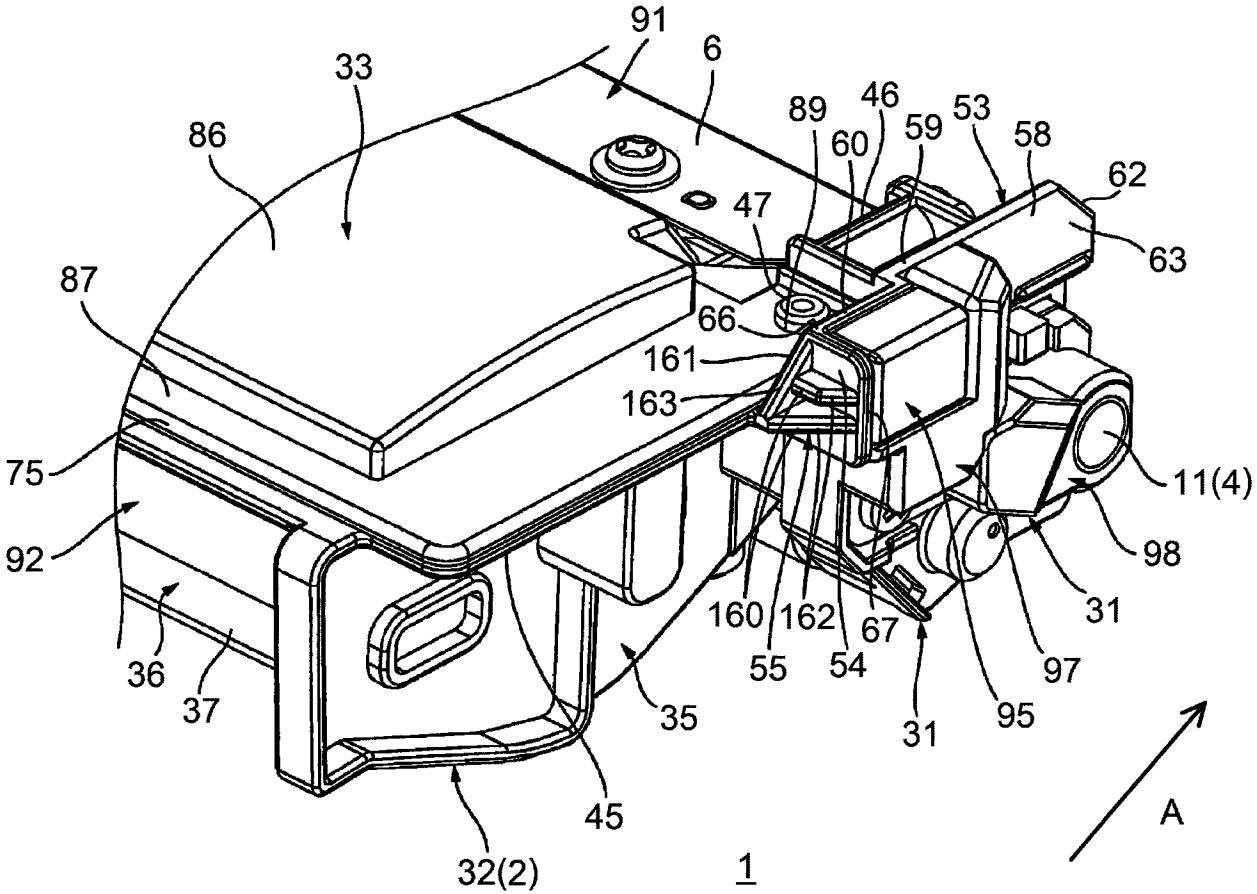
FIG. 10 is a right front perspective view depicting a rightward portion of a developing cartridge in a second illustrative embodiment according to one or more aspects of the disclosure.

Referring to FIG. 10, a developing cartridge according to a second illustrative embodiment will be described below. In the second illustrative embodiment, an explanation will be given mainly for the parts different from the first illustrative embodiment, and an explanation will be omitted for the common parts by assigning the same reference numerals thereto.

In the first illustrative embodiment, as depicted in FIG. 1B, the connecting portion 55 includes the single first rib 68 and the plurality of, for example, two, the second ribs 69.

Nevertheless, in the second illustrative embodiment, for example, as depicted in FIG. 10, the connecting portion 55 includes a plurality of, for example, two, first ribs 160 and a single second rib 161.

The plurality of first ribs 160 are spaced apart from each other and are aligned in the up-down direction. The lower first rib 160 has a substantially plate shape and connects a substantially middle portion of the right end of the right flange portion 45 in the front-rear direction and the front surface of the right end portion 67 of the second protruding wall 54 with each other. The upper first rib 160 also has a substantially plate shape and connects a right surface of the second rib 161 and the front surface of the right end portion 67 of the second protruding wall 54 with each other.

The first ribs 160 extends to a right end of the second protruding wall 54 so that a right end of each of the first ribs 160 is contiguous with the right end of the second protruding wall 54. The first ribs 160 each include a first inclined surface 162 that is inclined rightward toward the rear. Thus, the lower first rib 160 has a substantially triangular shape in plan view, and the upper first rib 160 has a trapezoidal shape in plan view.

The second rib 161 has a substantially plate shape and connects an upper surface of the lower first rib 160 and the front surface of the second protruding wall 54 with each other. That is, the second rib 161 overlaps the forward portion 60 of the first protruding wall 53 when projected in the front-rear direction. The second rib 161 includes a second inclined surface 163 that is inclined upward toward the rear. The second rib 161 has a substantially triangular shape in side view.

According to the second illustrative embodiment, the same effects as those obtained in the first illustrative embodiment may also be obtained.

9. Variations

The developing cartridges 1 according to the first and second illustrative embodiment are merely examples of a developing cartridge. The aspects of the disclosure are not limited to the above-described illustrative embodiments.

In the above-described illustrative embodiment, the developing electrode 98 includes the covering portion 126, the contact portion 127, and the connecting portion 131 that are in one piece. Nevertheless, in other embodiments, for example, the covering portion 126, the contact portion 127, and the connecting portion 131 may be separate members. For example, the covering portion 126 and the contact portion 127 may be made of a conductive resin material, and the connecting portion 131 may be made of a metallic material. The connecting portion 131 may connect the covering portion 126 and the contact portion 127 with each other in the developing electrode 98.

In other embodiments, for example, the connecting portion 131 may be made of an insulation material, and the shaft portion 11 of the developing roller 4 and the contact portion 127 may be connected with each other using a conductive material that may be disposed in a manner different from the connecting portion 131.

In the above-described illustrative embodiments, the supply electrode 95 includes the contact portion 101, the fixing portion 102, and the pass-through portion 105 that are in one piece. Nevertheless, in other embodiments, for example, the contact portion 101, the fixing portion 102, and the pass-through portion 105 may be separate members. For example, the contact portion 101 and the pass-through portion 105 may be made of a conductive resin material, and the fixing portion 102 may be made of a metallic material. The fixing portion 102 may connect the contact portion 101 and the pass-through portion 105 with each other in the supply electrode 95.

In other embodiments, for example, the fixing portion 102 may be made of an insulation material. The shaft portion 13 of the supply roller 5 and the contact portion 101 may be connected with each other using a conductive material that may be disposed in a manner different from the fixing portion 102.

In the above-described illustrative embodiments, the covering portion 126 covers the entire portion of the peripheral surface of the shaft portion 11 of the developing roller 5. Nevertheless, in other embodiments, for example, the covering portion 126 may be configured to cover at least a portion of the peripheral surface of the shaft portion 11 of the developing roller 5.

In the above-described illustrative embodiments, the covering portion 126 exposes therefrom the right end surface of the shaft portion 11 of the developing roller 5. Nevertheless, in other embodiments, for example, the covering portion 126 may be configured to cover the right end surface of the shaft portion 11 of the developing roller 5.

In the above-described illustrative embodiments, the developing roller 4 is used as a developing agent carrying member. Nevertheless, in other embodiments, for example, for example, a developing sleeve or a brush roller may be used as the developing agent carrying member.

In other embodiments, for example, the flat surface 134 and the flat surface 138 may have an uneven surface in the right-left direction while degree of unevenness thereof does not influence installation of the developing cartridge 1 to the printer 15.

In other embodiments, for example, the angle which the guide surface 140 of the connecting portion 131 forms with the right side-wall 35 may be determined appropriately within a range of from 1° to less than 90°.

In the above-described illustrative embodiments, the base frame 32 includes the first protruding wall 53 and the second protruding wall 54 that are in one piece. Nevertheless, in other embodiments, for example, the first protruding wall 53 and the second protruding wall 54 may be separate members.

In the above-described illustrative embodiments, the base frame 32 includes the first protruding wall 53 and the second protruding wall 54. Nevertheless, in other embodiments, for example, the cover frame 33 may include the first protruding wall 53 and the second protruding wall 54.

In the above-described illustrative embodiments, the second protruding wall 54 covers the entire portion of the flat surface 107 of the contact portion 101. Nevertheless, in other embodiments, for example, the second protruding wall 54 may be configured to cover at least a portion of the flat surface 107 of the contact portion 101.

In other embodiments, for example, the first protruding wall 53 and the second protruding wall 54 may cover at least a portion of the contact portion 101 in the up-down direction.

What is claimed is:

1. A developing cartridge comprising:
a developing roller extending in a first direction;
a housing configured to accommodate developer; and
a developing electrode provided at an exterior surface of the housing and including a first cylindrical support defined by a cylindrical inside surface, the developing roller contacting the cylindrical inside surface, the developing electrode of the developing electrode comprising:
a first surface extending along the exterior surface of the housing;
a second surface extending from the first surface toward an end of the developing roller and angled relative to the first surface;
a third surface extending from the second surface along the exterior surface of the housing, the cylindrical inside surface extends no further than the third surface.

2. The developing cartridge according to claim 1,
wherein the first surface extends in parallel with the third surface.

3. The developing cartridge according to claim 1,
wherein the housing has a first side wall and a second side wall spaced away from the first side wall in the first direction,
wherein the first surface and the third surface extend along an exterior surface of the first side wall.

4. The developing cartridge according to claim 3,
wherein the exterior surface of the first side wall extends in a second direction perpendicular to the first direction.

5. The developing cartridge according to claim 3,
wherein the first surface is separated from the first side wall by a third distance in the first direction,
wherein the third surface is separated from the first side wall by a fourth distance in the first direction, and
wherein the third distance is greater than the fourth distance.

6. The developing cartridge according to claim 1,
wherein the cylindrical inside surface includes an inner peripheral surface.

7. The developing cartridge according to claim 1,
wherein the first surface is flat.

8. The developing cartridge according to claim 1,
wherein the third surface is flat.

9. The developing cartridge according to claim 1,
wherein the developer roller includes a first shaft and a body portion covering a portion of the first shaft.

10. The developing cartridge according to claim 9,
wherein the cylindrical inside surface has one end and another end opposite to the one end in the first direction,
wherein the one end is separated from the body portion by a first distance,
wherein the another end is separated from the body portion by a second distance,
wherein the second distance is smaller than the first distance, and
wherein the one end of the cylindrical inside surface is open and extends to the third surface.

11. The developing cartridge according to claim 9,
wherein the first cylindrical support is a first through hole, and
wherein the first shaft includes an end surface, the end surface being exposed outside through the first through hole.

12. The developing cartridge according to claim 11,
wherein the end surface of the first shaft is flush with the third surface.

13. The developing cartridge according to claim 1, further comprising:
a supply roller including a second shaft;
a supply electrode including a second cylindrical support defined by an second cylindrical inside surface, the second shaft contacting the second cylindrical inside surface; and
an insulation member disposed between the developing electrode and the supply electrode.

14. The developing cartridge according to claim 13,
wherein the supply electrode includes a fourth surface extending along the exterior surface of the housing.

15. The developing cartridge according to claim 14, wherein the insulation member includes a first protector portion and a second protector portion,
wherein the first protector portion is adjacent to the fourth surface in a second direction perpendicular to the first direction, and
wherein the second protector portion is adjacent to the fourth surface in a third direction perpendicular to the first direction and intersecting with the second direction.

* * * * *